US011382809B2

(12) United States Patent
Peskin et al.

(10) Patent No.: US 11,382,809 B2
(45) Date of Patent: Jul. 12, 2022

(54) REMOVABLE POWER ASSIST FOR MANUAL WHEELCHAIR

(71) Applicant: RODA FUTURA, LLC, Miami, FL (US)

(72) Inventors: Evan Peskin, Miami, FL (US); Vivek Nagar, Rancho Palos Verdes, CA (US); Audrey Wilson, Miami, FL (US); Jonathan Slavin, Beachwood, OH (US)

( * ) Notice: Subject to any disclaimer, the term of this patent is extended or adjusted under 35 U.S.C. 154(b) by 0 days.

(21) Appl. No.: 17/478,873

(22) Filed: Sep. 17, 2021

(65) Prior Publication Data

US 2022/0000687 A1 Jan. 6, 2022

Related U.S. Application Data

(63) Continuation of application No. 17/221,196, filed on Apr. 2, 2021, now Pat. No. 11,154,443, which is a continuation-in-part of application No. 17/169,399, filed on Feb. 5, 2021, which is a continuation-in-part of application No. 16/689,931, filed on Nov. 20, 2019, now Pat. No. 10,945,899, which is a (Continued)

(51) Int. Cl.
*A61G 5/04* (2013.01)
*A61G 5/08* (2006.01)

(52) U.S. Cl.
CPC ..... *A61G 5/047* (2013.01); *A61G 5/0816* (2016.11)

(58) Field of Classification Search
CPC ..... A61G 5/047
See application file for complete search history.

(56) References Cited

U.S. PATENT DOCUMENTS

| | | | |
|---|---|---|---|
| 1,273,684 | A | 7/1918 | Small |
| 2,798,565 | A | 7/1957 | Rosenthal et al. |
| 3,100,547 | A | 8/1963 | Rosenthal |

(Continued)

FOREIGN PATENT DOCUMENTS

| | | | |
|---|---|---|---|
| WO | 1992/010157 | A1 | 6/1992 |
| WO | 2004/047707 | A2 | 6/2004 |

*Primary Examiner* — Minnah L Seoh
*Assistant Examiner* — Harold Eric Pahlck, III
(74) *Attorney, Agent, or Firm* — Hollowell Patent Group; Kelly Hollowell

(57) ABSTRACT

Apparatus and associated methods relate to a removable power assist for converting a manual wheelchair into an electronic wheelchair, based on configuring a friction roller to releasably engage with a wheelchair wheel, configuring the friction roller when engaged to drive the wheel through a contact surface with the wheel that may be positioned under the wheelchair seating area, or to the side of the wheelchair seating area, or to the underside of an armrest, or in front of a wheelchair wheel, configuring a motor to rotate the friction roller, and moving the wheelchair based on engaging the friction roller and activating the motor to turn the wheel through force by the friction roller against the contact surface with the wheel. Some designs include a lever configured to permit a user seated in the wheelchair to engage or disengage the friction roller. Configuring the friction roller under the wheelchair seating area, or to the side of the wheelchair seating area, or to the underside of an armrest, or in front of a wheelchair wheel may permit wheelchair folding or unfolding without uninstalling the power assist.

23 Claims, 14 Drawing Sheets

Related U.S. Application Data continuation-in-part of application No. 16/395,391, filed on Apr. 26, 2019, now Pat. No. 10,517,780.

(60) Provisional application No. 62/663,289, filed on Apr. 27, 2018.

(56) References Cited

U.S. PATENT DOCUMENTS 3,100,860 A 8/1963 Rosenthal
3,786,887 A 1/1974 Rosenthal
3,814,199 A 6/1974 Jones
3,893,529 A 7/1975 Karchak, Jr.
4,050,533 A 9/1977 Seamone
4,140,192 A 2/1979 Sharpe
4,141,094 A 2/1979 Ferguson et al.
4,296,361 A 10/1981 Archer
4,418,776 A 12/1983 Weirick
4,422,515 A 12/1983 Loveless
4,641,720 A 2/1987 Young
4,652,026 A 3/1987 Byrge
4,805,711 A * 2/1989 Lautzenhiser ..... A61G 5/045 180/342
4,961,473 A * 10/1990 Jones ..... A61G 5/045 180/6.5
5,078,227 A 1/1992 Becker
5,125,468 A * 6/1992 Coker ..... A61G 5/047 180/13
5,156,226 A 10/1992 Boyer et al.
5,222,567 A 6/1993 Broadhead
5,542,690 A 8/1996 Kozicki
5,555,949 A 9/1996 Stallard et al.
5,562,174 A 10/1996 Chen
5,735,363 A 4/1998 Horovitz
5,762,154 A 6/1998 Hsu
5,938,282 A 8/1999 Epple
6,050,356 A 4/2000 Takeda et al.
6,145,612 A 11/2000 Dickie
6,273,212 B1 8/2001 Husted
6,371,228 B1 4/2002 Husted
6,547,018 B1 * 4/2003 Choi ..... A61G 5/047 180/11
7,484,746 B2 2/2009 Mills
7,581,604 B2 9/2009 Torita
9,050,226 B2 6/2015 Husted et al.
10,124,666 B2 11/2018 Cunningham
10,517,780 B2 12/2019 Peskin et al.
10,919,602 B2 2/2021 Chi-Hsueh
10,945,899 B2 3/2021 Peskin et al.
11,154,443 B2 10/2021 Peskin et al.
2002/0019686 A1 2/2002 Ulrich
2004/0007401 A1 1/2004 Chu
2005/0269797 A1 12/2005 Mitchel
2006/0096792 A1 * 5/2006 Usherovich ..... A61G 5/1054 180/11
2010/0193278 A1 8/2010 Husted
2011/0308880 A1 12/2011 Chiu
2012/0080243 A1 4/2012 Mulhern
2012/0279789 A1 11/2012 Brill et al.
2014/0183930 A1 7/2014 Wei
2014/0232085 A1 8/2014 Hsiao-Wecksler
2016/0136019 A1 5/2016 Studebaker
2018/0280213 A1 * 10/2018 Hancock ..... A61G 5/08
2019/0291815 A1 9/2019 Viglione
2019/0328592 A1 10/2019 Peskin et al.
2020/0085653 A1 3/2020 Peskin et al.

* cited by examiner

REMOVABLE POWER ASSIST FOR MANUAL WHEELCHAIR

CROSS-REFERENCE TO RELATED APPLICATIONS

This application is a continuation of U.S. patent application Ser. No. 17/221,196 filed Apr. 22, 2021, which is a continuation-in-part of U.S. patent application Ser. No. 17/169,399 filed Feb. 5, 2021, which is a continuation-in-part of U.S. patent application Ser. No. 16/689,931 filed Nov. 20, 2019, issued as U.S. Pat. No. 10,945,899 on Mar. 16, 2021, which is a continuation-in-part of U.S. patent application Ser. No. 16/395,391 filed Apr. 26, 2019, issued as U.S. Pat. No. 10,517,780 on Dec. 31, 2019, which claims priority to U.S. Provisional Application No. 62/663,289 filed on Apr. 27, 2018, the entire contents of which are incorporated herein by references in their entirety.

BACKGROUND

The present application generally relates to a removable power assist for a manual wheelchair, and more particularly relates to a device for converting a manual wheelchair into an electric wheelchair.

In 2011, an estimated 2.7 million Americans used a wheelchair on a regular basis; up from 1.8 million in 1995. Based off the 2011 Census, 46,000,000 Americans are disabled and receiving income-based assistance. Of that group, 18.2% report ambulatory difficulty. There is also a population that needs a wheelchair temporarily e.g. 2-12 months and would prefer not to incur the expense of an electronic wheelchair even though it is preferred over a manual wheelchair.

Electronic wheelchairs and many of the innovations in the field are very expensive; and there is a significant price gap between the most expensive manual wheelchair and the cheapest electronic wheelchair, which often ranges in the thousands of dollars. Other limitations of electric wheelchairs, in addition to cost, include: portability (foldable); weight; and structural bulk. There are devices on the market for converting manual wheelchairs to electronic wheelchairs but they are flawed so that they cannot be installed by an end user sitting in the chair, are heavy, not portable, have poor surface contact for the propulsion system and/or cannot be disengaged without uninstalling the device from the chair.

What is needed is a device for converting a manual wheelchair into a power driven system in a cost effective, portable, easy to install and use, lightweight, alternately convertible from electric to manual without uninstalling the device. The device should be adaptable to existing manual wheelchairs without the need of professional installation.

SUMMARY

Apparatus and associated methods relate to a removable power assist for converting a manual wheelchair into an electronic wheelchair, based on configuring a friction roller to releasably engage with a wheelchair wheel, configuring the friction roller when engaged to drive the wheel through a contact surface with the wheel that may be positioned under the wheelchair seating area, or to the side of the wheelchair seating area, or to the underside of an armrest, or in front of a wheelchair wheel, configuring a motor to rotate the friction roller, and moving the wheelchair based on engaging the friction roller and activating the motor to turn the wheel through force by the friction roller against the contact surface with the wheel. Some designs include a lever configured to permit a user seated in the wheelchair to engage or disengage the friction roller. Configuring the friction roller under the wheelchair seating area, or to the side of the wheelchair seating area, or to the underside of an armrest, or in front of a wheelchair wheel may permit wheelchair folding or unfolding without uninstalling the power assist.

Apparatus and associated methods relate to a removable power assist for converting a manual wheelchair into an electronic wheelchair, based on configuring a friction roller to releasably engage with a wheelchair wheel, configuring the friction roller when engaged to drive the wheel through a contact surface with the wheel above the wheel center and behind the wheelchair seating area, configuring a motor to rotate the friction roller, and moving the wheelchair based on engaging the friction roller and activating the motor to turn the wheel through force by the friction roller against the contact surface with the wheel. The power assist may include a user-operable lever configured to engage or disengage the friction roller without a user leaving their seated position in the wheelchair. Configuring the friction roller above the wheel center and behind the wheelchair seating area may permit collapsible wheelchair folding or unfolding without uninstalling the power assist.

Disclosed are a device and method to convert a manual wheelchair into an electronic wheelchair. The device includes a joystick, a communication unit, a motor, a retractable friction roller, an engagement unit and a power source. The joystick is operably connected to a communication unit. The communication unit is operably connected to a motor. The motor includes an axle connected to a rotor. The retractable friction roller is mounted on the axle. The roller is placed in contact with a wheel of a manual wheelchair. The engagement unit is attached to the manual wheelchair to detachably attach the friction roller and the wheel. The power source is operably connected to the motor and the joystick.

In accordance with teachings of the present invention a device for converting a manual wheelchair into an electronic wheelchair is provided. Herein described is a manual wheelchair accessory device configured to attach to a manual wheelchair that will convert the manual wheelchair to an electric wheelchair, while still retaining the advantages that manual wheelchairs provide. The device includes an attachable power source affixed to a standard manual wheelchair.

In one embodiment, the present invention provides a device having a joystick, a communication unit, a motor, a retractable friction roller, an engagement unit and a power source. The joystick is operably connected to a communication unit. The communication unit is operably connected to a motor. The motor includes an axle connected to a rotor. A retractable friction roller is mounted on the axle. The roller is placed in contact with a wheel of a manual wheelchair. The engagement unit is attached to the manual wheelchair to detachably attach the friction roller to the wheel. The power source is operably connected to the motor and the joystick.

In one embodiment, the present invention provides a second motor that is operably connected to a second communication unit and the power source. The second communication unit is operably connected to the joystick. The second motor includes a second axle connected to a second rotor. This embodiment includes a second friction roller that is mounted on the second axle. The second roller is placed in contact with a second wheel of the manual wheelchair to facilitate powered motion. In another embodiment, the joystick may be operably connected to the rotors and is operably programmable to generate commands for the motors.

The present invention easily converts a manual wheelchair to a powered, smart wheelchair. Features of the present invention include 1) using the friction roller's contact to the wheel to generate directed movement; 2) the ability to engage and disengage the friction roller to the wheels of the wheelchair which allows the user to propel the wheelchair with manual propulsion while the device is still attached to the wheelchair—a feature essential if the battery or motor cease to function; 3) the ability to fold the wheelchair with device attached to it without altering the folding of or normal space occupied by a standard manual wheelchair; 4) unit portability. In one embodiment, the device includes a safety guard to prevent a user's fingers from becoming caught in the motor or the gears. In another embodiment, the motors are bi-directional and independent of one another so that the motor attached to each wheelchair wheel can turn the opposite direction and rotate the wheelchair in place. Using the present invention, both acute and long-term care wheelchair companies and individual users can affordably bring their equipment and standard of care to a higher, professional level.

DETAILED DESCRIPTION

While various embodiments of the present disclosure are disclosed, it should be understood that they are presented as examples only, and are not intended to be limiting. Similarly, the drawings and diagrams depict structural or architectural examples or alternate configurations of the invention, which are provided to aid in understanding the features and functionality of the various embodiments of the invention but are not intended to be limiting. The embodiments and features may be implemented and/or altered in a variety of ways known to those of ordinary skill the art.

Figure 1:
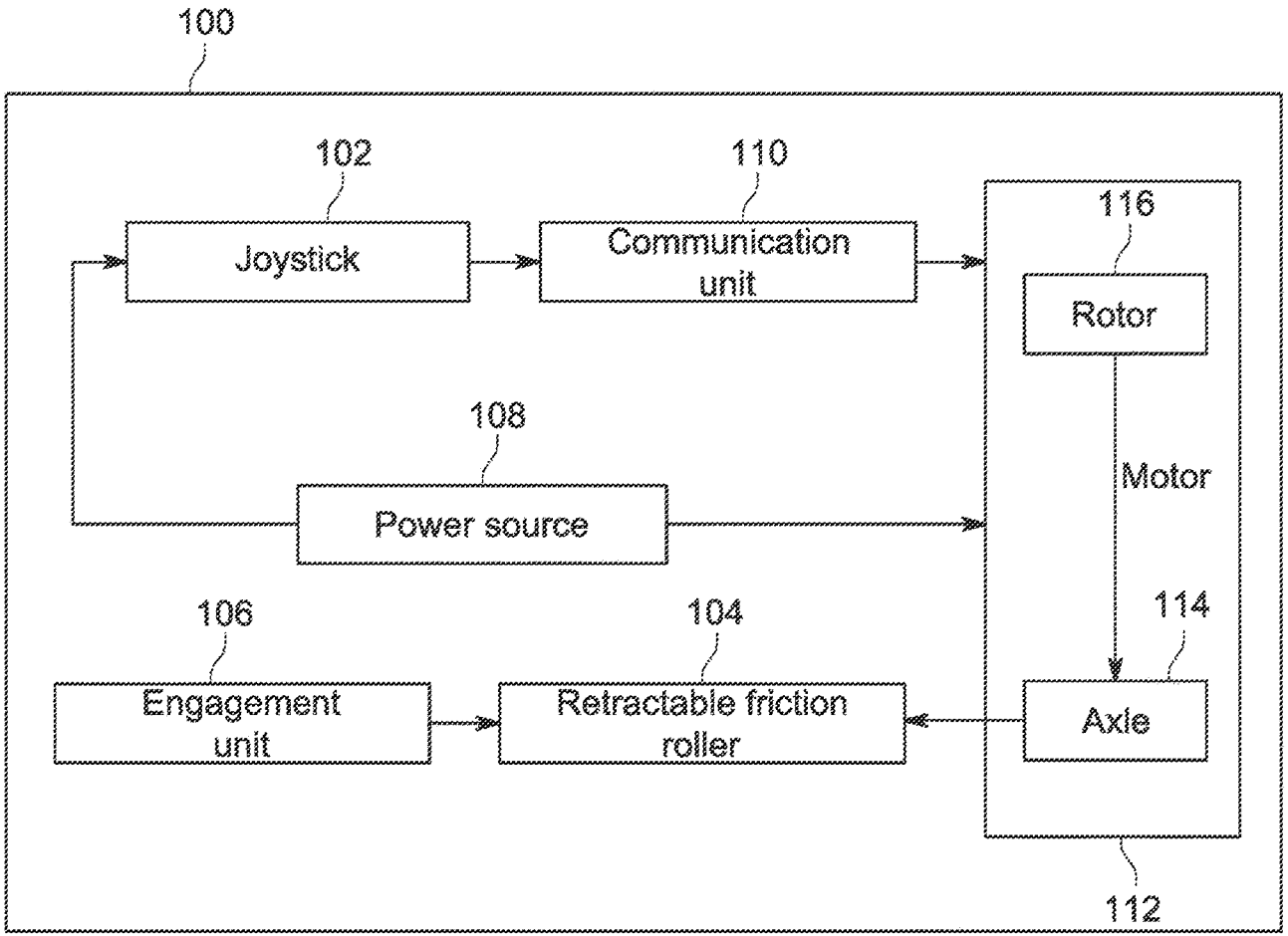
FIG. 1 illustrates a block diagram of a device in accordance with an embodiment of the present invention.

FIG. 1 illustrates a block diagram of the device 100 in accordance with one embodiment of the present invention. In this embodiment, the device 100 includes a joystick 102, a retractable friction roller 104, an engagement unit 106 and a power source 108. The joystick 102 is operably connected to a communication unit 110. The joystick 102 is explained in detail in conjunction with FIGS. 2A-2E and FIG. 3 of the present invention.

The communication unit 110 is operably connected to a motor 112. The communication unit 110 is explained in detail in conjunction with FIGS. 2A-2E of the present invention. The motor 112 includes an axle 114 and a rotor 116. The motor 112 is explained in detail in conjunction with FIG. 3 of the present invention. The axle 114 is shown and explained in detail in conjunction with FIG. 4 of the present invention.

The retractable friction roller 104 is mounted on the axle 114. During operation of the device 100, the retractable friction roller 104 is put in contact with at least one wheel 206 (shown in FIGS. 2A-2E) of a manual wheelchair 202 (shown in FIGS. 2A-2E). The retractable friction roller 104 is explained in detail in conjunction with FIG. 3 and FIG. 4 of the invention.

The engagement unit 106 is attached to the wheelchair 202 (shown in FIGS. 2A-2E) to detachably attach the retractable friction roller 104 and the wheel (shown in FIGS. 2A-2E). The engagement unit 106 is explained in detail in conjunction with FIG. 3, FIG. 4 and FIG. 5 of the present invention. The power source 108 is operably connected to the motor 112 and the joystick 102. The power source 108 is shown and explained in detail in conjunction with FIG. 5 of the present invention. The device 100 converts the manual wheelchair 202 into an automatic wheelchair.

Figure 2A:
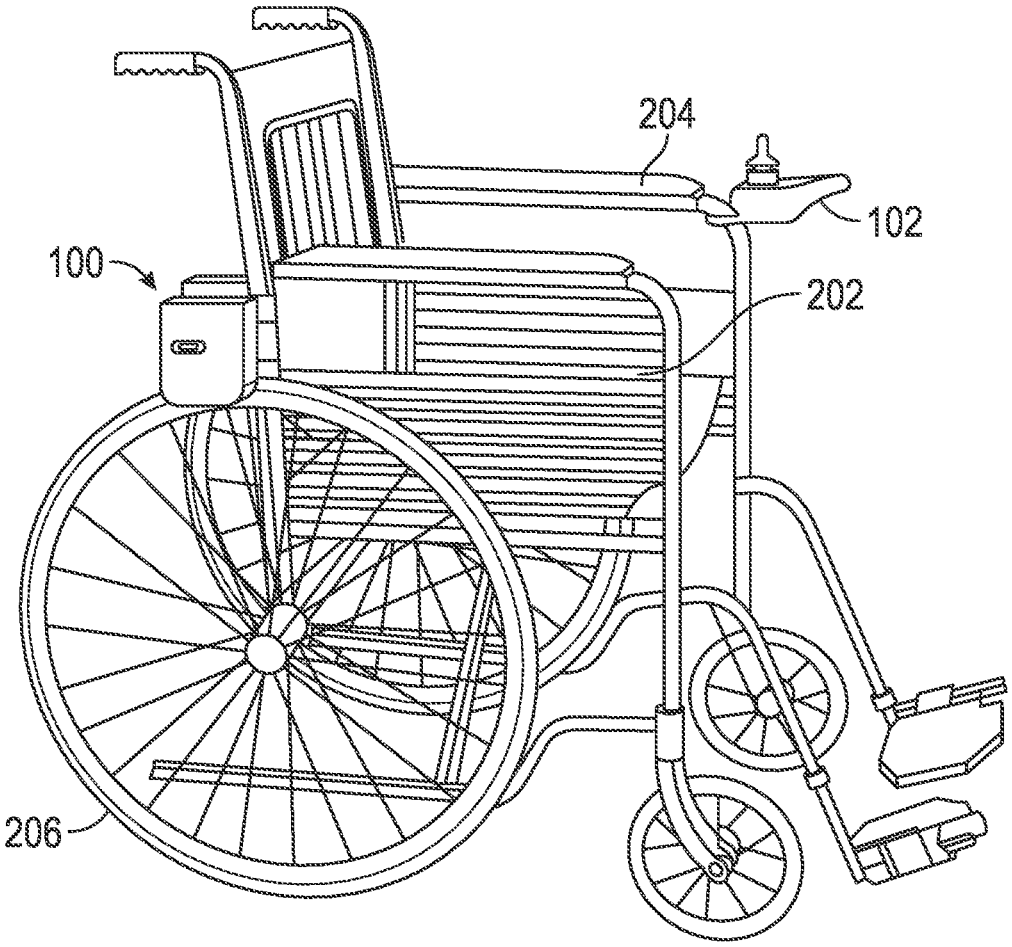
FIGS. 2A-2E illustrate side views of an exemplary power assist device attached to a manual wheelchair in accordance with exemplary embodiments of the present invention.

FIG. 2A illustrates a side view of one embodiment of device 100 attached to a manual wheelchair 202. The joystick 102 allows the user to control the direction and speed of the motor 112 (shown at least in FIGS. 1, 3, 11A, and 11B). In an embodiment, the joystick 102 is attached to an arm 204 of the manual wheelchair 202.

In one embodiment, a user is able to control the direction, movement and speed of the device 100 using the joystick 102. More specifically, the movement and speed of the wheel 206 of the wheelchair 202 is controlled by user instructions using the joystick 102 and the communication unit 110 (shown in FIG. 3).

In the example depicted by FIG. 2A, the exemplary power assist device 100 includes a friction roller configured to drive when engaged the wheel 206. The friction roller is further described with reference to at least FIGS. 3, 5-6, 7A, 9, 10A-B, and 11A-D. In FIG. 2A, the power assist device 100 is attached to the wheelchair 202 above the wheel 206 center and behind the wheelchair 202 seating area. In the example depicted by FIG. 2A, the friction roller is configured to drive when engaged the wheel 206 through a friction roller contact surface with the wheel 206 that is above the wheel 206 center and behind the wheelchair 202 seating area. As described in further detail with reference to at least FIGS. 9, 10A, and 10B, configuring the friction roller to contact the wheel 206 above the wheel 206 center and behind the wheelchair 202 seating area may leave open the space behind the wheelchair 202 seating area, permitting the power assist device 100 installation and removal from behind the wheelchair 202 while the wheelchair 202 seat is occupied by a person riding in the wheelchair 202. Leaving open the space behind the wheelchair 202 seating area as a result of configuring the friction roller to contact the wheel 206 above the wheel 206 center and behind the wheelchair 202 seating area may permit folding and unfolding the wheelchair 202 without uninstalling the power assist device 100.

Figure 2B:
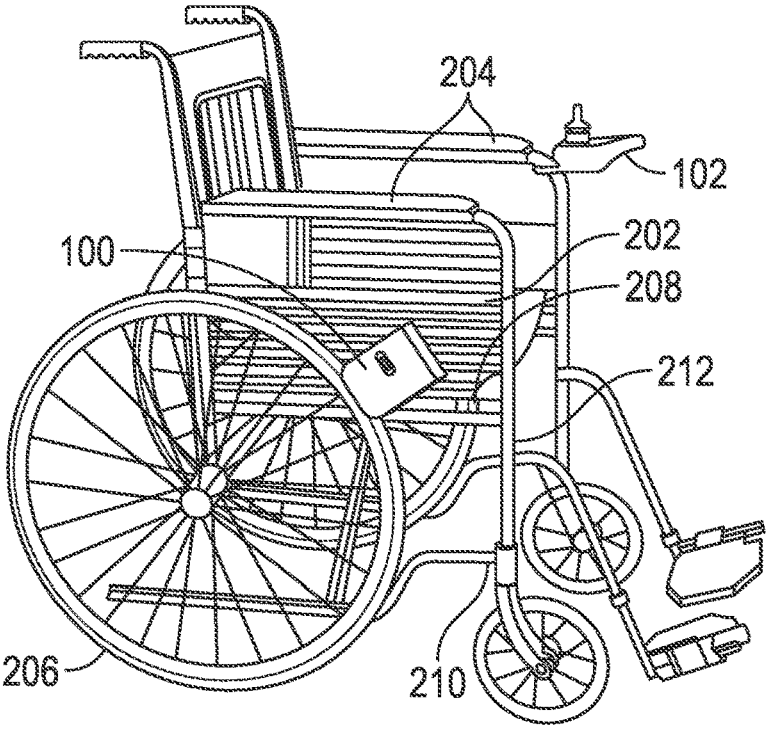

In the example depicted by FIG. 2B, the exemplary power assist device 100 includes a friction roller configured to drive when engaged the wheel 206. In FIG. 2B, the power assist device 100 is attached to the upper lateral wheelchair frame support 208, to position the power assist device 100 in front of the wheel 206 and to the side of the wheelchair 202 seating area. The exemplary wheelchair 202 depicted by FIG. 2B also includes the lower lateral wheelchair frame support 210, the vertical wheelchair frame support 212, and arms 204.

Figure 2C:
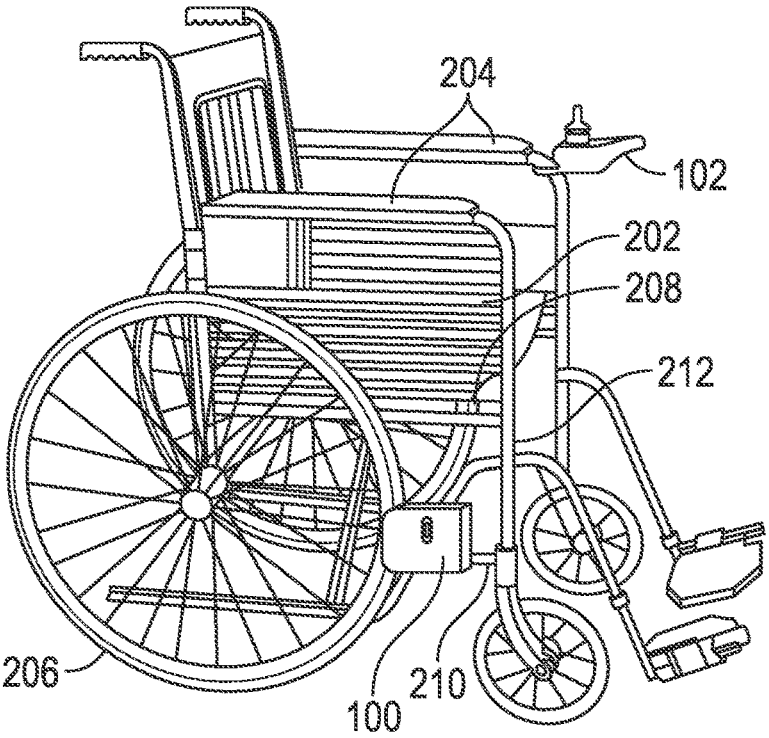

In the example depicted by FIG. 2C, the exemplary power assist device 100 includes a friction roller configured to drive when engaged the wheel 206. In FIG. 2C, the power assist device 100 is attached to the lower lateral wheelchair frame support 210, to position the power assist device 100 in front of the wheel 206 and to the side of the wheelchair 202 seating area. The exemplary wheelchair 202 depicted by FIG. 2C also includes the upper lateral wheelchair frame support 208, the vertical wheelchair frame support 212, and arms 204.

Figure 2D:
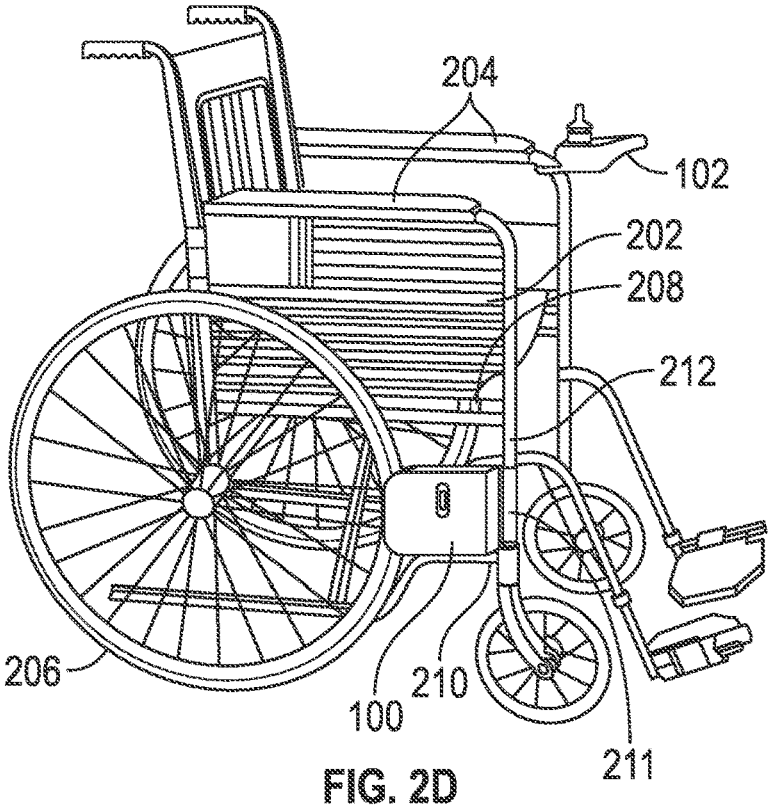

In the example depicted by FIG. 2D, the exemplary power assist device 100 includes a friction roller configured to drive when engaged the wheel 206. In FIG. 2D, the power assist device 100 is attached by power assist bracket 211 to the vertical wheelchair frame support 212, to position the power assist device 100 in front of the wheel 206 and to the side of the wheelchair 202 seating area. The exemplary wheelchair 202 depicted by FIG. 2D also includes the upper lateral wheelchair frame support 208, the lower lateral wheelchair frame support 210, and arms 204.

Figure 2E:
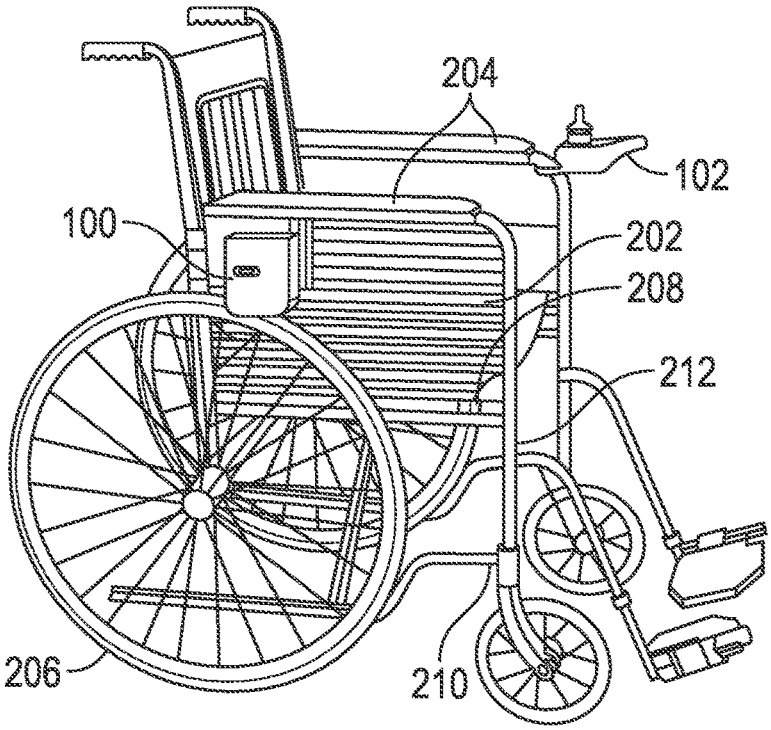

In the example depicted by FIG. 2E, the exemplary power assist device 100 includes a friction roller configured to drive when engaged the wheel 206. In FIG. 2E, the power assist device 100 is attached to the wheelchair 202 below the arm 204, to position the power assist device 100 above the wheel 206 center and to the side of the wheelchair 202 seating area. The exemplary wheelchair 202 depicted by FIG. 2E also includes the upper lateral wheelchair frame support 208, the lower lateral wheelchair frame support 210, and the vertical wheelchair frame support 212.

FIGS. 2A-2E each depict one side of an exemplary wheelchair 202 implementation according to the present disclosure. In view of the present disclosure it will be understood that the exemplary wheelchair 202 implementations depicted by FIGS. 2A-2E are illustrative of a wheelchair 202 having an exemplary power assist device configured on both sides of the wheelchair 202, for example as described in further detail at least with reference to FIGS. 3, 9, 10A, and 10B. Multiple power assist devices may be attached to an exemplary wheelchair in multiple ways. For example, a combination of the power assist attachment locations illustrated by FIGS. 2A-2E may be configured to attach multiple power assist devices to an exemplary wheelchair. In some designs, the exemplary wheelchair 202 implementations depicted by FIGS. 2A-2E may include a power assist device 100 attached to one side of the wheelchair 202 below the arm 204 as depicted by FIG. 2E, and the wheelchair 202 may also include a second power assist device 100 attached on the other side of the wheelchair to the wheelchair 202 upper lateral wheelchair frame support 208 as depicted by FIG. 2B. In some implementations, one power assist device 100 may be attached to the wheelchair 202 above the wheel 206 center and behind the wheelchair 202 seating area as depicted by FIG. 2A, and the wheelchair 202 may also include a second power assist device 100 attached on the other side to the wheelchair 202 lower lateral wheelchair frame support 210. In an illustrative example, an exemplary wheelchair 202 implementation may include any combination of the power assist device 100 attachment configurations depicted by FIGS. 2A-2E. Some example wheelchair 202 designs may include more than two power assist devices. For example, a wheelchair 202 may be configured with four power assist devices 100. In a wheelchair 202 implementation including four power assist devices 100 attached to the wheelchair 202, each of two wheelchair 202 main wheels may be driven by two friction rollers. In an illustrative example, a wheelchair having multiple power assist devices with multiple friction rollers driving one wheel may have increased load carrying capacity. Some example wheelchair implementations may include power assist devices configured with an engagement unit adapted to engage or disengage multiple friction rollers from one wheel substantially at the same time. For example, multiple friction rollers may be operably linked with a spring-loaded connecting rod to releasably engage or disengage a secondary friction roller from a wheel when the primary friction roller is engaged or disengaged by user operation of an engagement unit. Various exemplary wheelchair implementations may include multiple power assist devices each configured with an independent engagement unit permitting a user to separately and independently engage or disengage multiple friction rollers from one wheel. An exemplary wheelchair implementation configured to permit a user to independently engage or disengage multiple friction rollers from one wheel may permit a user to adapt the wheelchair's thrust to the load or terrain. For example, a wheelchair could be adapted to carry a heavier load such as additional luggage based on engaging a secondary power assist device including a second friction roller driven by a second motor, to increase thrust to the same wheel already driven by a primary power assist device including a primary friction roller driven by a primary motor. Such an example wheelchair configuration including multiple independently operable motors and friction rollers adapted to drive each wheel may permit a user to operate the wheelchair more effectively in hilly or mountainous terrain based on engaging multiple motors and friction rollers per wheel when needed, and engaging only one motor and friction roller per wheel on less hilly terrain.

In an embodiment the communication unit 110 (shown in FIG. 3) and the second communication unit 304 (shown in FIG. 3) is a wired communication unit. Examples of the communication unit 110 (shown in FIG. 3) and the second communication unit 304 (shown in FIG. 3) include but not limited to cables, wires, Bluetooth®, NFC. It would be readily apparent to those skilled in the art that various types of communication unit such as wired or wireless unit may be envisioned without deviating from the scope of the present invention.

In one embodiment, the joystick 102 is programmable and enabled to store instructions for controlling the speed and direction of motor 112 (shown in FIG. 1). The joystick 102 receives power from the power source 108 (shown in FIG. 1). The use of a battery operated joystick is known for controlling power wheelchairs. The joystick 102 may be a device that is compatible with commercially available joystick devices designed to be plugged in and disconnected by an end user, to reduce user effort and expense replacing the joystick due to wear and tear through normal use. The joystick 102 may be a Bluetooth® enabled joystick, permitting remote control of the wheelchair within the communication range of the device using a wireless joystick that is not physically installed in the wheelchair. For example, the user riding in the wheelchair may hold a Bluetooth® enabled or wireless joystick 102 in either hand, or in any way that is comfortable or effective, to operate their wheelchair without constraint by a wired or permanently installed joystick. The joystick 102 may include a pop socket ring holder configured to permit a user to effectively manipulate a wireless joystick that is not physically installed in the wheelchair.

In one embodiment, the power source 108 is a battery. The batteries may be rechargeable such as but not limited to using an ordinary 110V or 220V charger. Sample batteries that may work with this device include but are not limited to a primary battery (non-chargeable) and secondary batteries such as Lithium-ion (Li-ion), Nickel Cadmium (Ni—Cd), Nickel-Metal Hydride (Ni-MH) and Lead-Acid.

Figure 3:
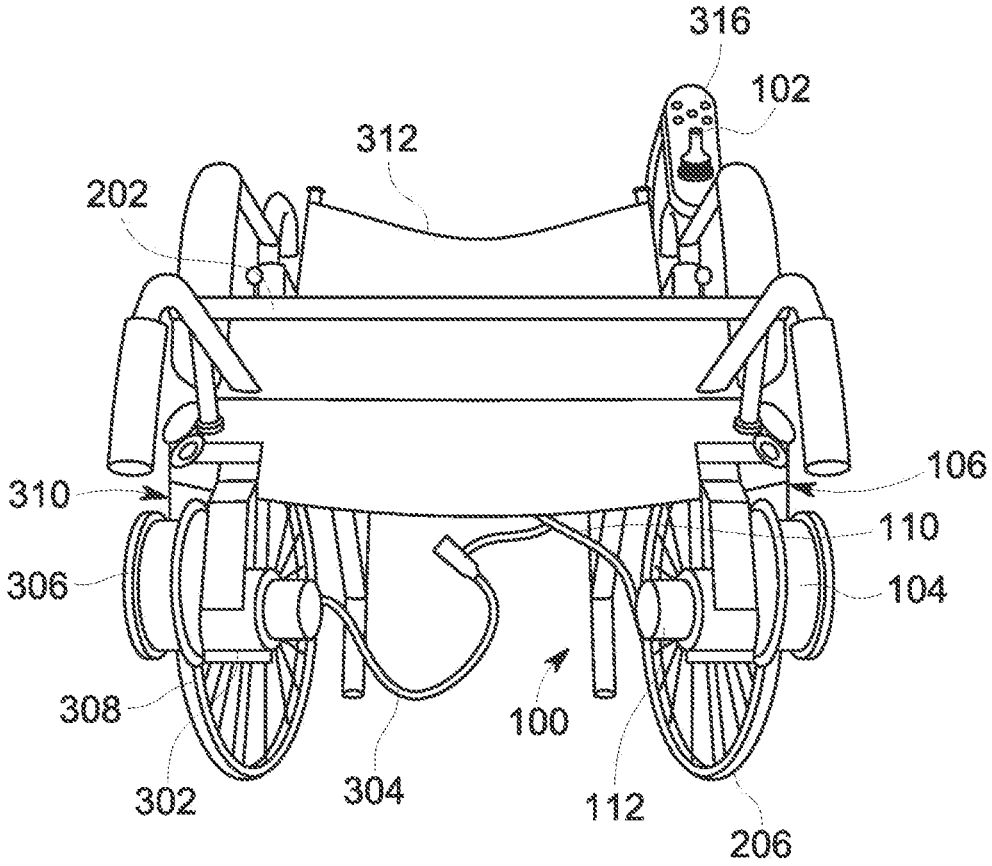
FIG. 3 illustrates a top perspective view of the device attached to the manual wheelchair in accordance with an embodiment of the present invention.

FIG. 3 illustrates a top perspective view of the device 100 attached to the manual wheelchair 202 in accordance with an embodiment of the present invention. In this configuration, the retractable friction roller 104 is mounted on the axle 114 (shown in FIG. 1) and rotated by activation of the motor 112.

In one embodiment, the device includes a motor with a friction surface. The motor may be an electric motor. The motor may be an Alternating Current (AC) motor. The motor may be a Direct Current (DC) motor. The DC motor may be a brushless DC motor. The motor may be a speed control motor. The motor may be a geared motor. The motor may be a brushed motor. The motor may be a hub motor. The motor may be a brushless hub motor. The motor may be a worm gear motor. In an illustrative example, the motor may be any other type of motor including, but not limited to, a geared hub motor, a brushed hub motor, a brushless geared hub motor, a brushed geared hub motor, a non-hub motor, or any other similar motor. Hub motors are very common in power wheelchairs but are typically used for separate wheels that contact the ground directly.

In the present invention, the retractable friction roller 104 is placed in contact with at least one wheel 206 of the manual wheelchair 202 to rotate the wheel 206 and move the wheelchair 202. The retractable friction roller 104 rotates the wheel 206 by friction force. This is a unique feature of the present invention. Other devices are commonly based on motor to ground movements, PAW uses a friction roller to the wheel to generate movement.

In one embodiment, the retractable friction roller 104 is shaped to have a centerless concave rim housing configured to provide high friction surface facing the wheel 206 of the wheelchair 202. The centerless concave rim housing acts as a wheel hub to yield a high percentage of surface contact. In one embodiment, the high friction surface of the retractable friction roller 104 faces the wheelchair wheel 206 and is customizable to fit the curve and or size of the wheel 206.

In an embodiment, the material of high friction surface of the retractable friction roller 104 is rubber or polyurethane. However, it would be readily apparent to those skilled in the art that various types of material such as silicone, foam, sand paper, grit tape, sponge-rubber foam etc. may be envisioned without deviating from the scope of the present invention. In another embodiment, the wheels 206 of wheelchair 202 are made using a high friction surface, and the roller 104 is made of steel, aluminum or other similar hardened, textured surface.

The motor 112 is configured to rotate the retractable friction roller 104. The retractable friction roller 104 is mounted on the axle 114 (shown in FIG. 1) and the rotor 116 (shown in FIG. 1) rotates the first axle resulting in rotation of the retractable friction roller 104. In an embodiment, the motor 112 is a brushless DC motor with a friction surface. However, it would be readily apparent to those skilled in the art that various types of motor such as geared hub motor, brushed hub motor, brushed geared hub motor etc. may be envisioned without deviating from the scope of the present invention.

In another embodiment, the device 100 further includes a second motor 302 operably connected to a second communication unit 304 and the power source 108 (shown in FIG. 1). The communication unit 110 and the second communication unit 304 are both operably connected to the joystick 102. In another embodiment, the joystick 102 may further include control buttons 316 operably connected to the motor. The control buttons 316 controls speed of the motor 112 (shown in FIG. 3).

The second motor 302 includes a second axle (not shown) connected to a second rotor (not shown). In this embodiment, the device 100 further includes a second friction roller 306 mounted on the second axle (not shown). The second roller 306 is placed in contact with a second wheel 308 of the manual wheelchair 202. Alternatively, the second roller 306 is mounted to the axle 114 and the motor 112 provides motor torque to rotate the second friction roller 306 and the friction roller 104 (not shown).

Similarly, to the retractable friction roller 104, the second retractable friction roller 306 includes a centerless concave rim housing configured to provide high friction surface facing the second wheel 308 of the wheelchair 202. The principle and function of the second motor 302 and second friction roller 306 is the same as the motor 112 and retractable friction roller 104 as previously described.

In another embodiment of the present invention, the device 100 further includes a second engagement unit 310 attached to the manual wheelchair 202 to detachably attach the second friction roller 306 and the second wheel 308 of the wheelchair 202. The engagement unit 106 detachably attaches the friction roller 104 and the wheel 206. The engagement unit 106 and the second engagement unit 310 is attached behind seating area 312 of wheelchair 202 and top of the wheel 206 and the second wheel 308, respectively.

Figure 4:
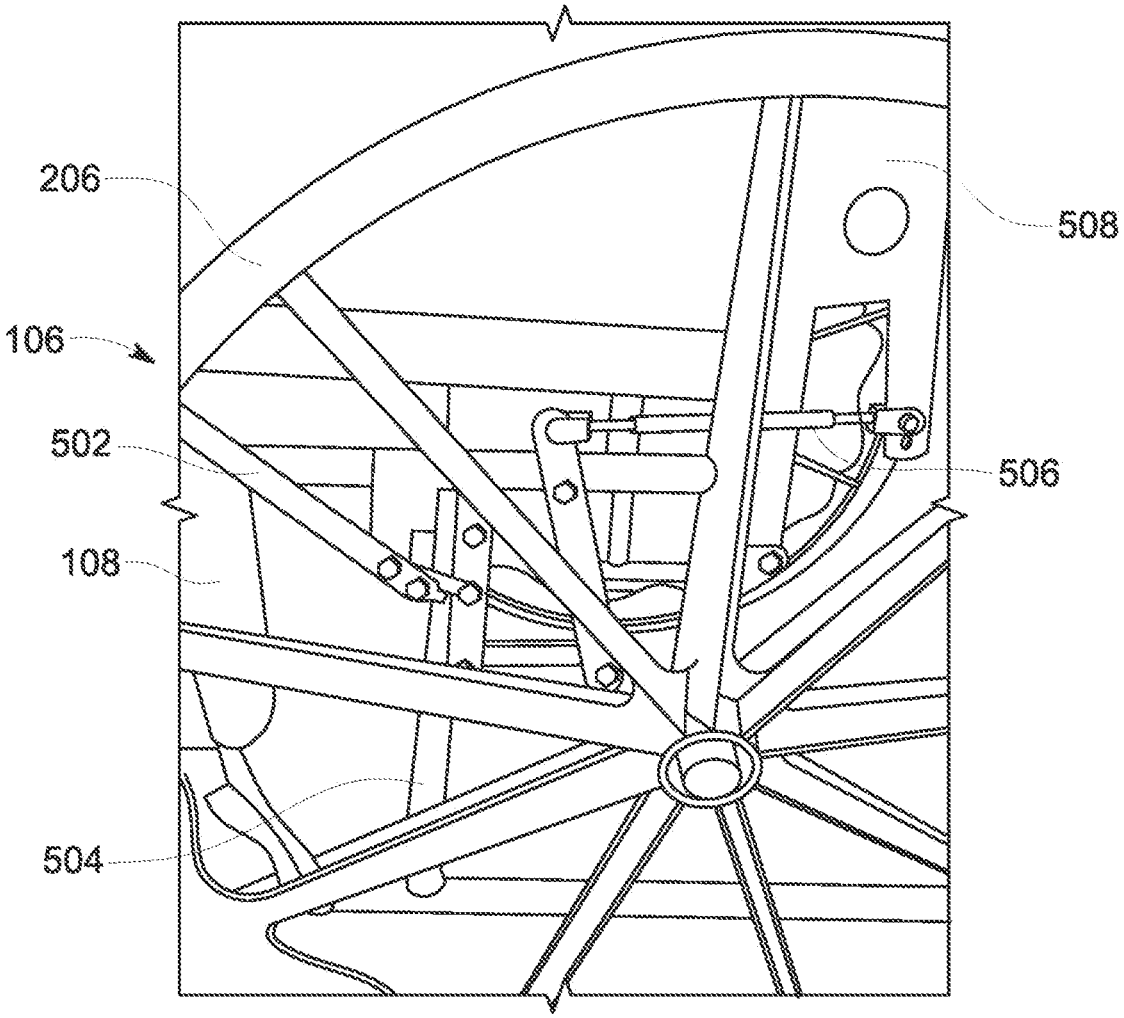
FIG. 4 illustrates a perspective view of an engagement unit in accordance with another embodiment of the present invention.

FIG. 4 illustrates perspective view of engagement unit 106 in accordance with another embodiment of the present invention. The engagement unit 106 includes a lever 502 operably connected to a lever mechanism unit 504, a turnbuckle 506 connected to the lever mechanism unit 504 and an attachment unit 508 operably connected to the turnbuckle 506. The attachment unit 508 comprises clamps (shown in FIG. 5) and a spring loaded unit (shown in FIG. 5).

The retractable friction roller (104, shown in FIG. 3) is operably connected to the turnbuckle 506. The lever 502 is actuated by the user and results in engaging and disengaging of the retractable friction roller (104, shown in FIG. 3) from the wheel 206. Thus, the lever 502 results in converting a manual wheelchair into an electronic wheelchair and vice versa.

Figure 6:
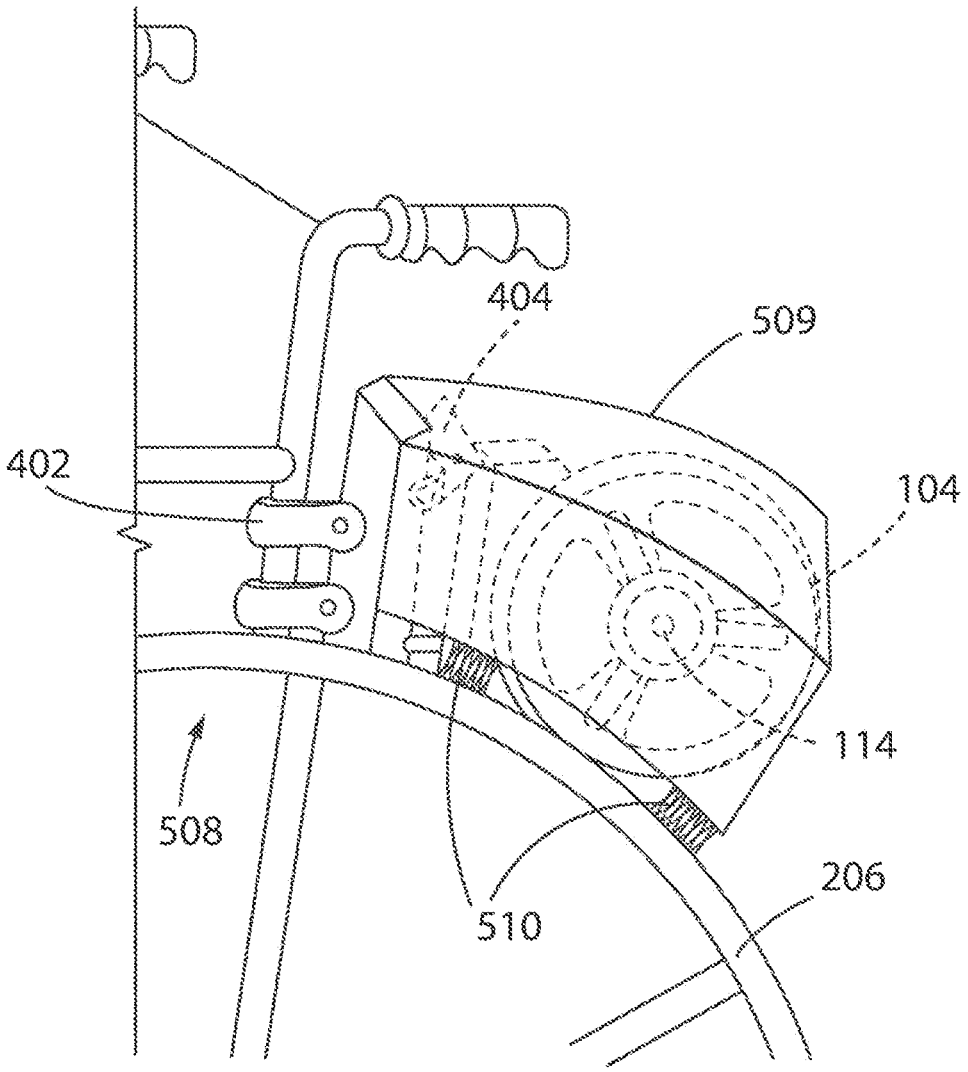
FIG. 6 illustrates a perspective view of the device with a protective fender in accordance with another embodiment of the present invention.

In FIG. 6 another embodiment of the device 100 is shown with a safety fender 509 also herein referred to as a cover, protective cap and/or shield; which comprises a top, an open bottom, a right side, a left side, a proximal side and distal side wherein each of the four sides has a bottom edge and at least one set of brushes 510 is attached to the bottom edge of the distal side of the safety fender 509 and the safety fender 509 is detachably attached to the wheelchair 202 such as but not limited to attachment by clamps 402 and wherein the safety fender 509 fits over the attachment friction roller 104. The safety fender 509 may be attached to a motor 112 (depicted at least in FIG. 3). The safety fender 509 may be attached to a second motor 302 (depicted at least in FIG. 3). The safety fender 509 may be attached to a bracket 704 (depicted at least in FIGS. 7A-7B). In one embodiment, the at least one set of brushes 510 are positioned on the bottom edge of the distal side of the fender so that the brushes 510 contact the wheel 206 of the wheelchair 202. In one embodiment, there are at least two sets of brushes 510 with one set of brushes positioned on the bottom edge of the distal side of the fender and the other set of brushes 510 positioned on the bottom side of the bottom edge of the proximal side of the fender. That is in front of and behind the friction roller 104 where friction roller 104 comes into contact with the wheel 206. It will be apparent to one of ordinary skill in the art that placement of the at least one set of brushes 510 may vary to optimize the contact between the friction roller 104 and the wheel 206. This is accomplished in part as the at least one set of brushes function to brush away and or clearing debris from coming in between the friction roller 104 and the wheel 206.

In one embodiment, the cover 509 is a protective barrier that shields the top and four sides of the protects the friction roller 104 and axle 114 from environmental exposure, debris and damage. In this regard, the fender 509 may improve the long-term use and function of the device 100 by protecting the friction roller 104 and axle 114 from environmental exposure and preventing environmental debris from impacting or entering into the inner functioning components of the device 100 motor through contact of the wheel 206 with the with the friction roller 104. The fender 509 is also a safety device. More specifically, the fender 509 improves the safety of the user by preventing clothing, hair, hands and fingers from being caught, snagged or trapped by the device especially as the wheel 206 rotates.

Figure 7A:
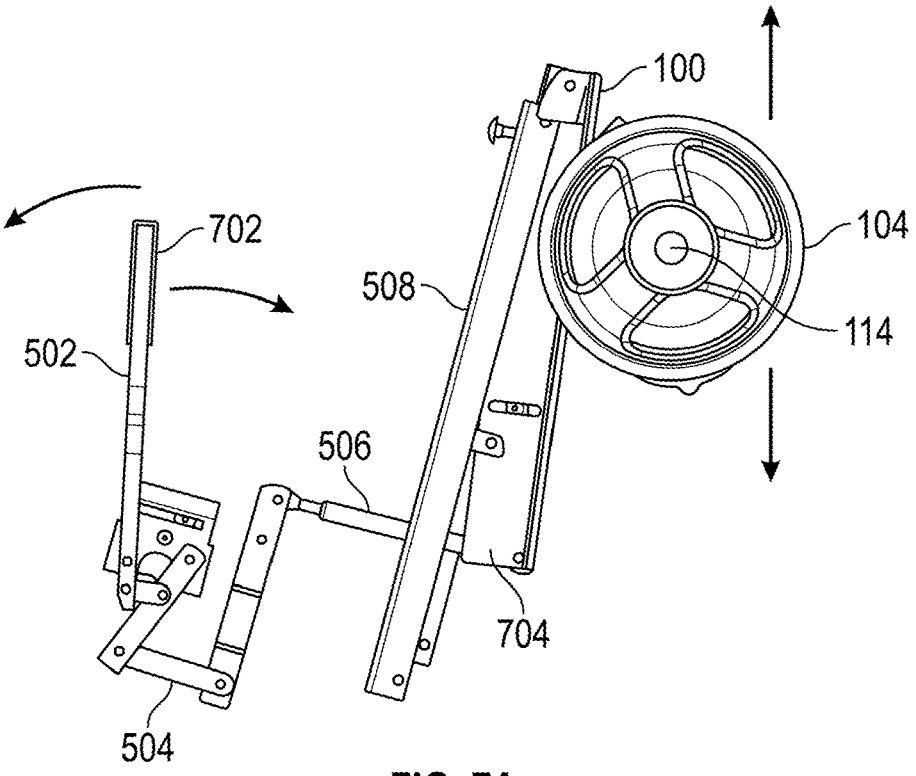
FIGS. 7A-7B together illustrate side views of exemplary wheelchair power assist device components.
Figure 7B:
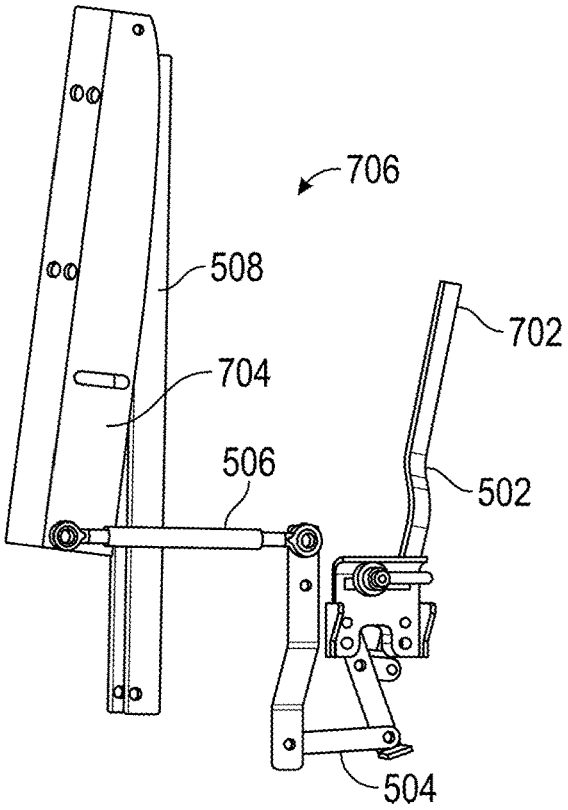

FIGS. 7A-7B together illustrate side views of exemplary wheelchair power assist device components. In FIG. 7A, the exemplary wheelchair power assist device 100 includes the friction roller 104 mounted to the axle 114. In the depicted example, the friction roller 104 is attached to a motor 112 (depicted at least in FIG. 3) and the motor 112 is attached to the bracket 704. The friction roller 104 may be attached to the bracket 704. In the illustrated example, the bracket 704 is configured to attach the motor 112 (depicted at least in FIG. 3) to a wheelchair 202 (depicted at least in FIG. 3) via the attachment unit 508. The bracket 704 may be configured to attach a second motor 302 (depicted at least in FIG. 3) with a second friction roller 306 (depicted at least in FIG. 3) and second axle 114 (depicted at least in FIG. 5), to adapt another of the two main wheels of an exemplary wheelchair 202 with a second wheelchair power assist device 100. In the depicted example, the top of the bracket 704 is pivotally coupled with the top of the attachment unit 508. The top of the bracket 704 may be pivotally coupled with the top of the attachment unit 508 by a swivel pin, for example. In the depicted example, the bottom of the bracket 704 is connected with the turnbuckle 506. Pivotally coupling the top of the bracket 704 with the top of the attachment unit 508, and connecting the bottom of the bracket 704 with the turnbuckle 506, permits the lower portion of the bracket 704 to move relative to the attachment unit 508 in response to operation of the lever 502 by the handle 702. In the depicted example, moving the lever 502 drives the turnbuckle 506 via the lever mechanism unit 504, thereby raising or lowering the friction roller 104 to releasably engage the friction roller 104 and a wheel 206 (depicted at least in FIG. 5) via operation of the lever mechanism unit 504. In the example depicted by FIG. 7A, the lower portion of the bracket 704 has been displaced away from the attachment unit 508 by operation of the lever 502.

In FIG. 7B, the exemplary wheelchair power assist device 100 operation unit 706 assembly includes the turnbuckle 506 connected to the bracket 704 and the lever mechanism unit 504. The lever mechanism unit 504 operably couples the lever 502 and handle 702 with the bracket 704 via the turnbuckle 506, permitting a user to releasably engage a friction roller 104 (depicted at least in FIG. 7A) and a wheel 206 (depicted at least in FIG. 5) via operation of the lever mechanism unit 504. In the example depicted by FIG. 7B, the lower portion of the bracket 704 has been displaced toward the attachment unit 508 by operation of the lever 502.

Figure 8:
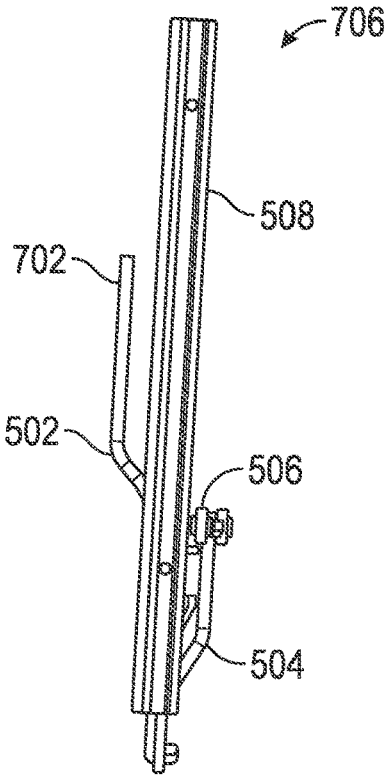
FIG. 8 illustrates a side view of an exemplary wheelchair power assist device operation unit assembly in an exemplary retracted configuration.

FIG. 8 illustrates a side view of an exemplary wheelchair power assist device operation unit assembly in an exemplary retracted configuration. In FIG. 8, the exemplary wheelchair power assist device operation unit assembly 706 components are shown retracted to collapse the operation unit assembly 706 to facilitate space-efficient storage and transport. In the depicted example, the exemplary wheelchair power assist device operation unit assembly 706 retracted configuration includes the lever 502 and handle 702 coupled via the lever mechanism unit 504 and turnbuckle 506 with the bracket 704 (depicted at least in FIGS. 7A and 7B) and attachment unit 508.

Figure 9:
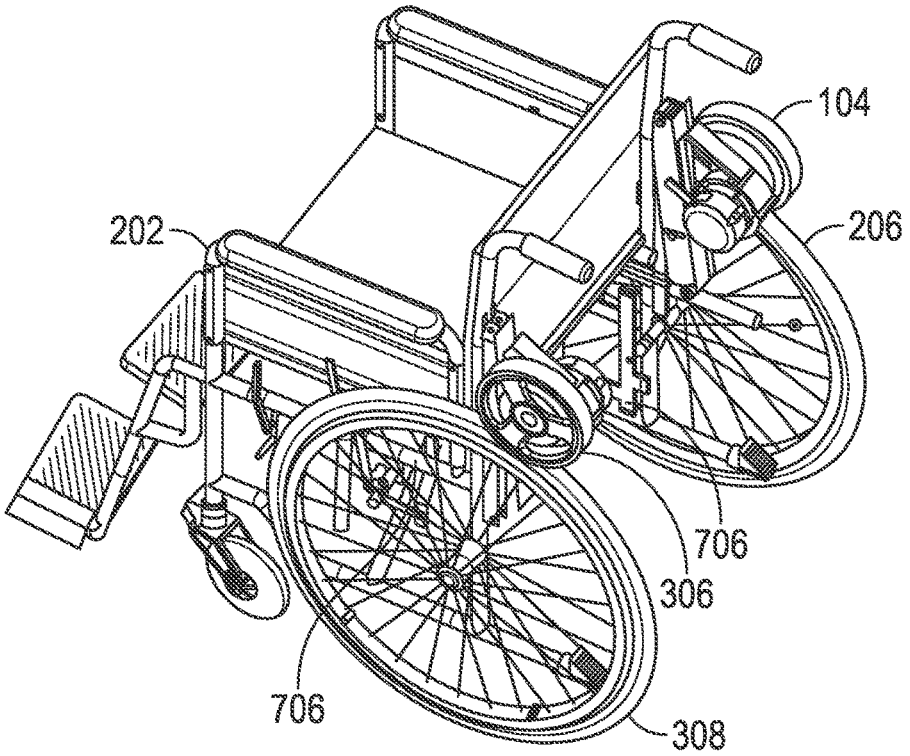
FIG. 9 illustrates a top perspective view of an exemplary wheelchair with two illustrative power assist devices each configured to drive one of the two depicted wheelchair main wheels.

FIG. 9 illustrates a top perspective view of an exemplary wheelchair with two illustrative power assist devices each configured to drive one of the two depicted wheelchair main wheels. In FIG. 9, the exemplary wheelchair 202 includes the main wheels 206 and 308. In the depicted example, the wheelchair 202 is configured with a wheelchair power assist device operation unit assembly 706 to drive the main wheel 206 via the friction roller 104. In the illustrated example, the wheelchair 202 is configured with a second wheelchair power assist device operation unit assembly 706 to drive the second main wheel 308 via the second friction roller 306. Configuring the friction roller 104 and 306 above the respective wheels 206 and 308, and at the rear of the wheelchair 202, permits wheelchair power assist device installation and removal from behind the wheelchair while the wheelchair 202 seat is occupied by a person riding in the wheelchair 202. While riding in the wheelchair 202, a person riding may releasably engage power assist to the wheel 206 by operating the lever 502 (depicted in FIGS. 7A and 7B) of the wheelchair power assist device operation unit assembly 706. The person while riding in the wheelchair 202 may releasably engage power assist to the second wheel 308 by operating the lever 502 (depicted in FIGS. 7A and 7B) of the second wheelchair power assist device operation unit assembly 706. When power assist to the wheels is disengaged by operation of the lever 502, the friction rollers 104 and 306 disengage from the respective wheelchair 202 wheels 206 and 308, and the wheelchair 202 operates normally with manual propulsion by the user turning the wheels 206 and 308 by hand. The person riding in the wheelchair 202 under manual propulsion may engage power assist to the wheels 206 and 308 by operating the lever 502, to engage the friction rollers with the wheels.

Figure 10A:
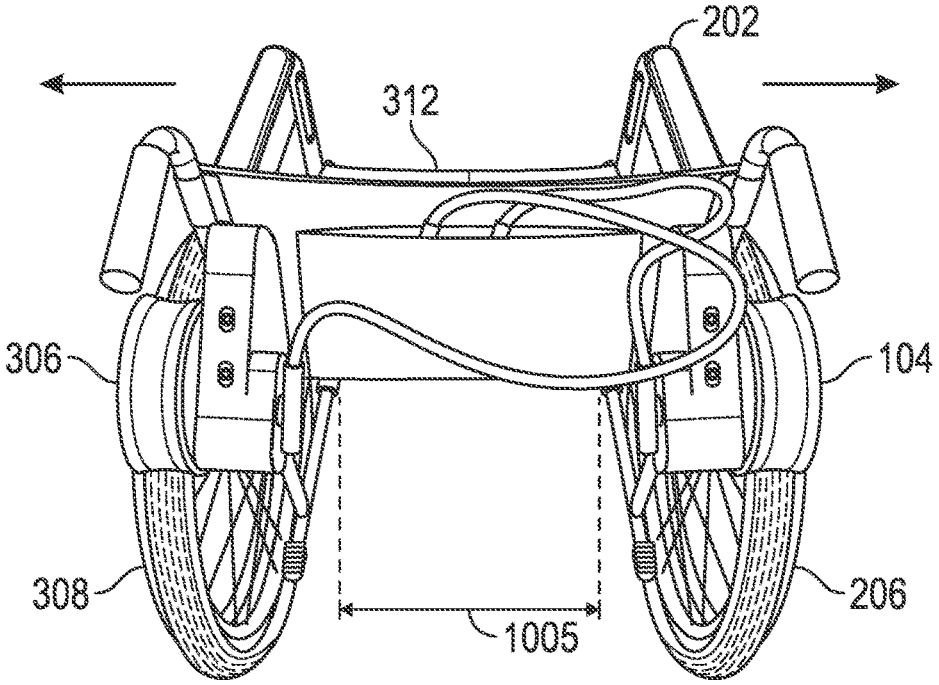
FIG. 10A illustrates a rear perspective view of an exemplary wheelchair with two illustrative power assist devices each configured to drive one of the two depicted wheelchair main wheels, with the wheelchair in an exemplary unfolded configuration.

FIG. 10A illustrates a rear perspective view of an exemplary wheelchair with two illustrative power assist devices each configured to drive one of the two depicted wheelchair main wheels, with the wheelchair in an exemplary unfolded configuration. In FIG. 10A, the exemplary wheelchair 202 is a collapsible wheelchair depicted in an illustrative unfolded configuration. In the depicted example, the friction roller 104 is configured to drive the wheel 206 by an exemplary power assist device (depicted for example by FIGS. 1-6, 7A-B, and 8-9). In the illustrated example, the second friction roller 306 is configured to drive the second wheel 308 by an exemplary second power assist device (depicted for example by FIGS. 1-6, 7A-B, and 8-9). In the depicted example, the friction rollers 104 and 306 are configured above the respective wheels 206 and 308, and behind the wheelchair 202 seating area 312. In the illustrated example, configuring the friction rollers 104 and 306 above the respective wheels 206 and 308, and behind the wheelchair 202 seating area 312, permits folding and unfolding the collapsible wheelchair 202 while the power assist devices remain installed, as a result of leaving open the space 1005 between the power assist devices. The friction rollers 104 and 306 may be disposed above the center of the respective wheels 206 and 308, between the respective wheel centers and the tops of the wheels, or above the wheels as depicted, to facilitate leaving open the space 1005 and permit folding and unfolding the collapsible wheelchair 202 while the power assist devices remain installed. In the illustrated example, the space 1005 is also left open as a result of the power assist device design that includes separate and distinct power assist devices each configured to drive one of the wheels 206, 308, without power assist device components occupying the space 1005. The wheelchair 202 may be folded while the power assist remains installed or attached to the wheelchair 202, independent of whether the power assist is engaged or disengaged, without affecting the folding action of the wheelchair 202, as a result of leaving the space 1005 open between the two power assist devices each configured to drive one of the wheels 206 and 308.

Figure 10B:
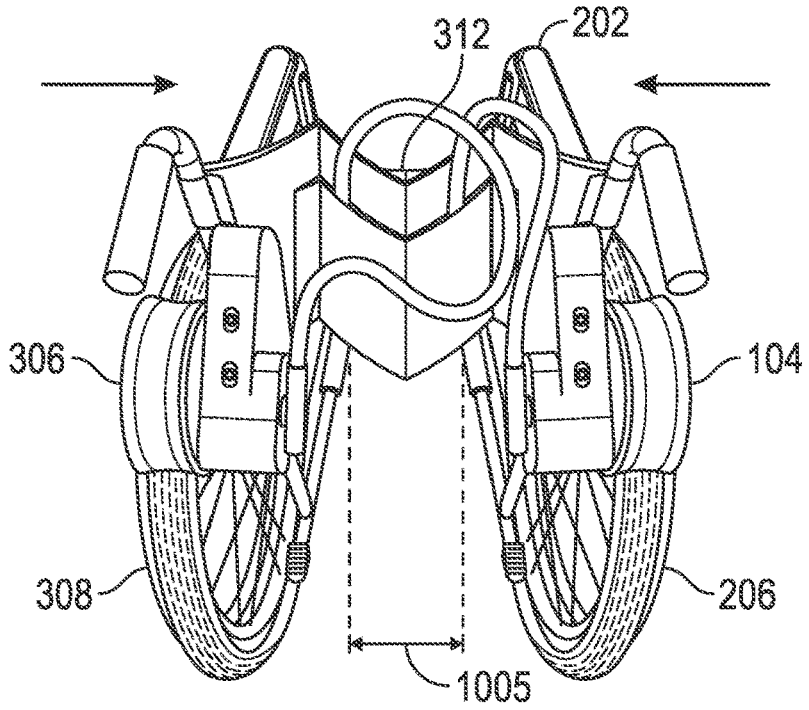
FIG. 10B illustrates a rear perspective view of an exemplary wheelchair with two illustrative power assist devices each configured to drive one of the two depicted wheelchair main wheels, with the wheelchair in an exemplary folded configuration.

FIG. 10B illustrates a rear perspective view of an exemplary wheelchair with two illustrative power assist devices each configured to drive one of the two depicted wheelchair main wheels, with the wheelchair in an exemplary folded configuration. In FIG. 10B, the exemplary wheelchair 202 is a collapsible wheelchair depicted in an illustrative folded configuration. In the depicted example, the friction rollers 104 and 306 are configured above the respective wheels 206 and 308, and behind the wheelchair 202 seating area 312. In the illustrated example, the collapsible wheelchair 202 has been folded while the power assist devices remained installed. This facilitation may be a result of the depicted power assist design, that leaves open the space 1005 between the power assist devices and behind the wheelchair 202 seating area 312, without power assist device components occupying the space 1005.

Figure 11A:
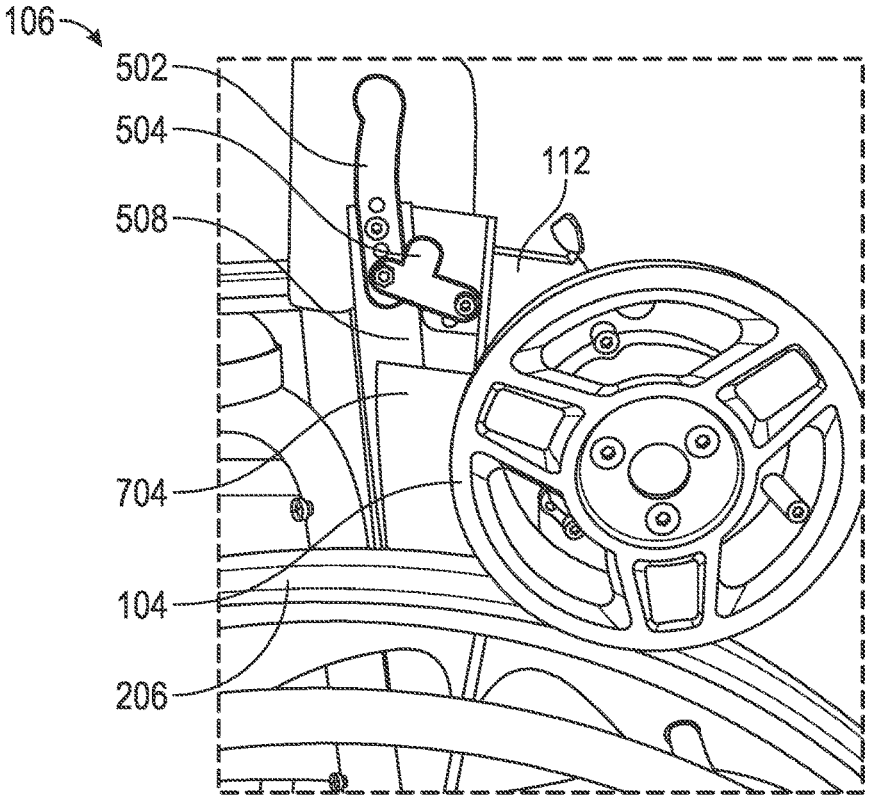
FIGS. 11A-11D illustrate perspective views of an exemplary engagement unit configured in exemplary disengaged and engaged modes.
Figure 11B:
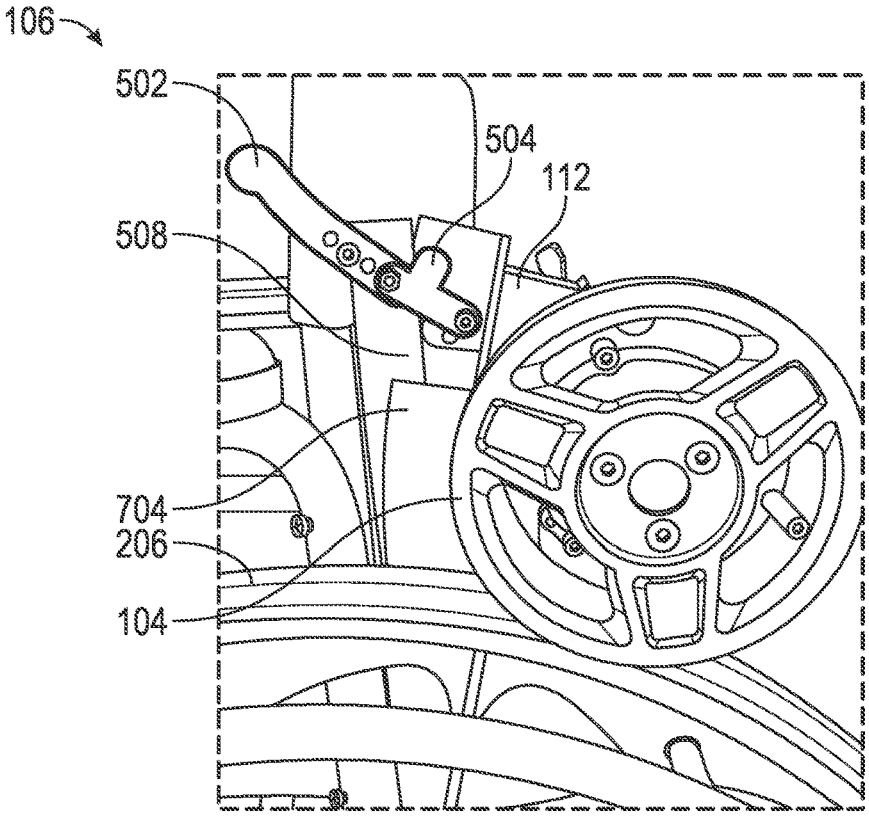
Figure 11C:
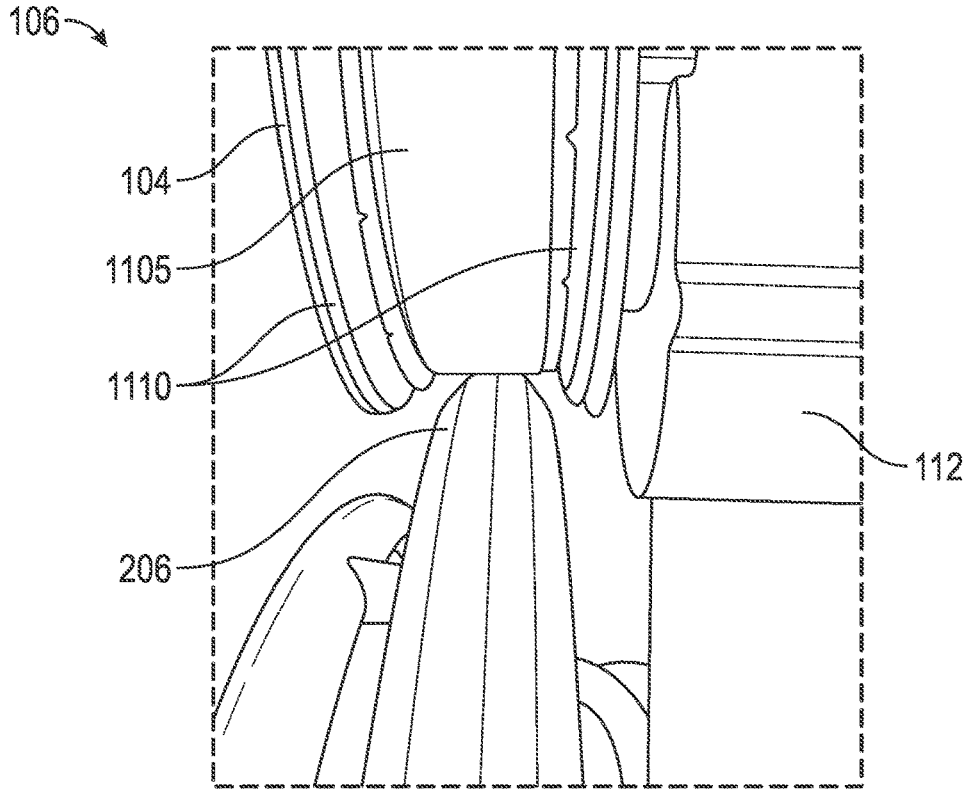
Figure 11D:
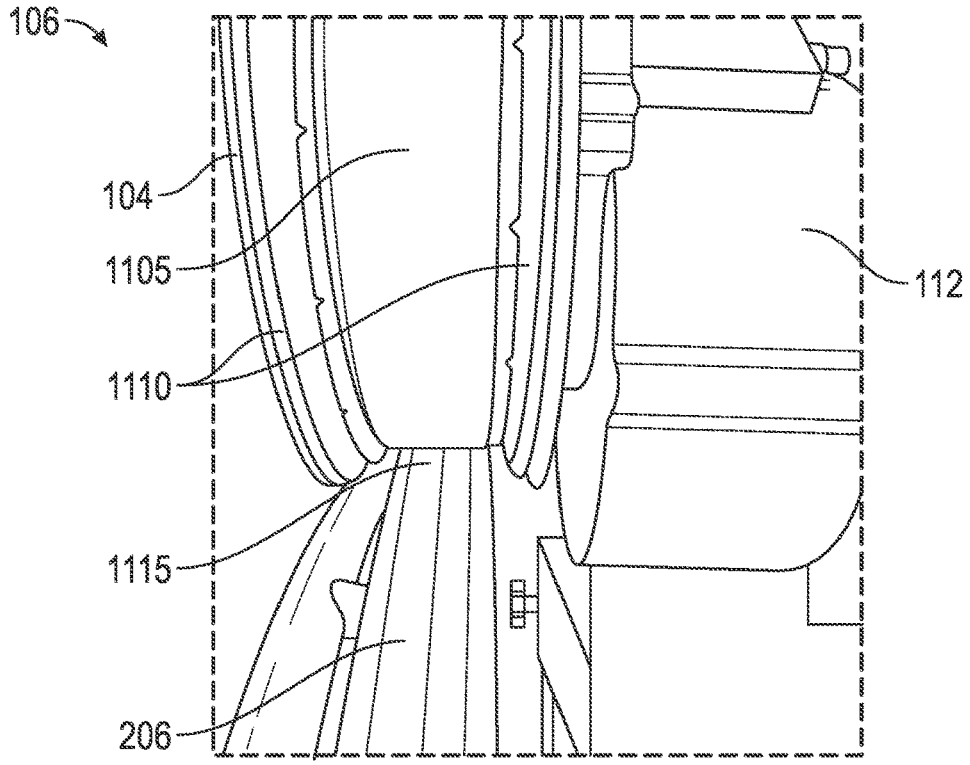

FIGS. 11A-11D illustrate perspective views of the exemplary engagement unit 106 (also depicted at least by FIGS. 1, 3, and 4) implementation in accordance with the present disclosure. FIG. 11A is a side perspective view of the engagement unit 106 depicted in an exemplary disengaged mode. FIG. 11B is a side perspective view of the engagement unit 106 illustrated in an exemplary engaged mode. FIG. 11C is a rear perspective view of the engagement unit 106 depicted in an exemplary disengaged mode. FIG. 11D is a rear perspective view of the engagement unit 106 depicted in an exemplary engaged mode.

In the examples depicted by FIGS. 11A-11D, the engagement unit 106 includes the lever 502 operably connected to the lever mechanism unit 504. The depicted friction roller 104 is configured with the friction surface 1105 (depicted by FIGS. 11C and 11D) designed to provide high friction with the wheel 206 when the friction roller 104 is in contact with the wheel 206.

In the illustrated examples, the lever mechanism unit 504 is attached to the motor 112 bracket to engage and disengage the friction roller 104 friction surface 1105 and the wheel 206. In the illustrated examples, the friction roller 104 includes the concave rim housing 1110 (depicted by FIGS. 11C and 11D) designed to fit the wheel 206 and function as a wheel hub to yield a high percentage of surface contact between the friction roller 104 and the wheel 206. The concave rim housing 1110 may be a centerless concave rim housing. In FIG. 11D, the friction roller 104 is depicted engaged with the wheel 206 at an exemplary point on the contact surface 1115 between the wheel 206 and the friction roller 104.

In the depicted examples, moving the lever 502 drives the lever mechanism unit 504, thereby raising or lowering the friction roller 104 to releasably engage the friction roller 104 and the wheel 206 via operation of the lever mechanism unit 504. In the example depicted by FIG. 11A, the upper portion of the bracket 704 has been displaced toward the attachment unit 508 by operation of the lever 502. In the example illustrated by FIG. 11B, the upper portion of the bracket 704 has been displaced away from the attachment unit 508 by operation of the lever 502.

In the illustrated examples, the exemplary engagement unit 106 includes a mechanical one button engage and disengage attached to the motor, to raise or lower the friction roller 104 and releasably engage the friction roller 104 and the wheel 206. The mechanical engage and disengage unit may be, for example, a linear actuator (depicted by FIG. 12A), linear slide rail (depicted by FIG. 12B), linear screw rail, or push/pull solenoid (depicted by FIG. 12C).

With reference to FIG. 1, in an embodiment of the present invention, the power source 108 is a battery. The batteries are chargeable using an ordinary 110V or 220V charger. Examples of battery include but not limited to primary battery (non-chargeable) and secondary batteries such as Lithium-ion (Li-ion), Nickel Cadmium (Ni—Cd), Nickel-Metal Hydride (Ni-MH), and Lead-Acid.

Figure 5:
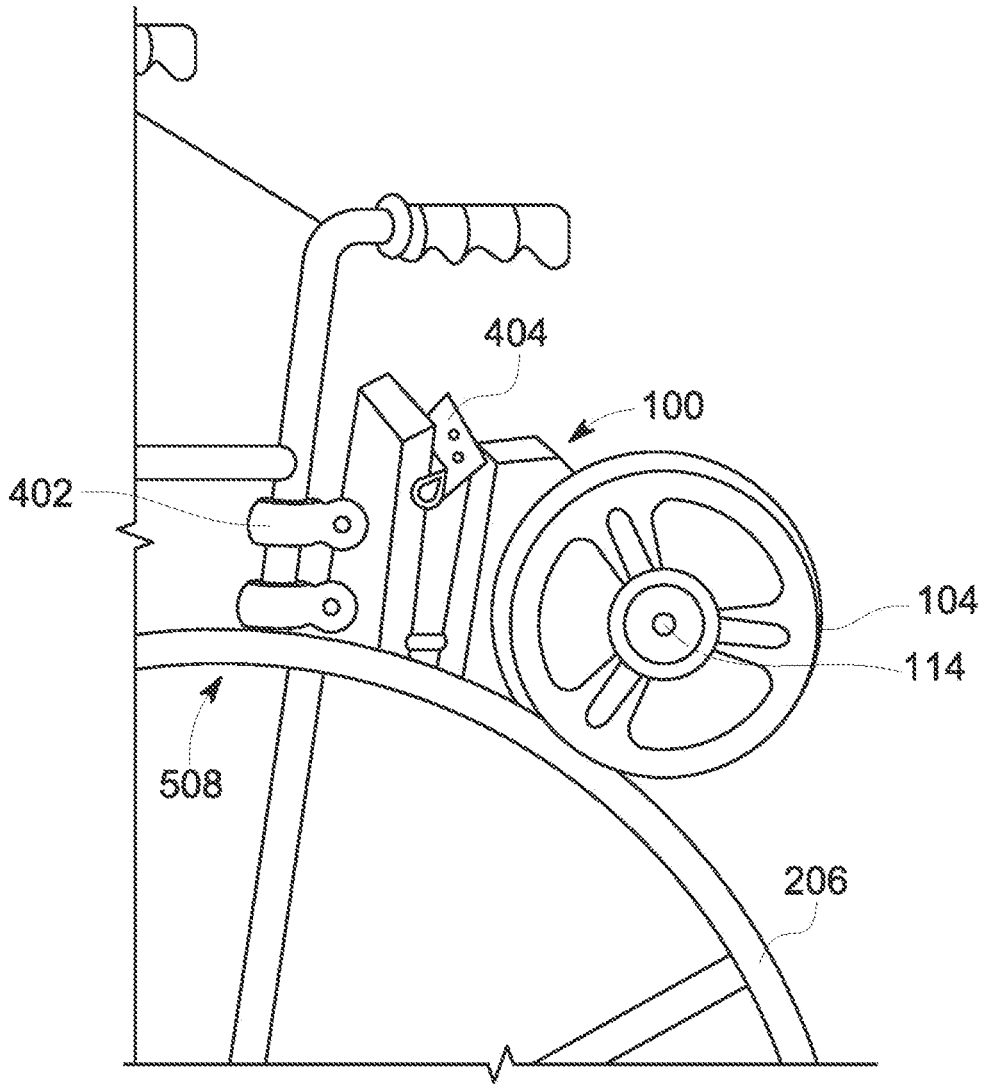
FIG. 5 illustrates a perspective view of the device in accordance with another embodiment of the present invention.

FIG. 5 illustrates perspective view of the device 100 in accordance with another embodiment of the present invention. The attachment clamps 402 and a spring loaded unit 404 engage and disengage the retractable friction roller 104 and the wheel 206.

With reference to FIG. 1, the friction roller 104 is mounted on the axle 114. In an embodiment of the present invention, the friction roller 104 has an opening to receive the axle 114. The axle 114 is a cylindrical elongated rod to pass through the opening to rotate the friction roller 104 on receiving motor torque from the rotor (116, shown in FIG. 1).

Examples of the attachment unit 508 are simple mechanical devices such as but not limited to spring, screw clamp, mechanical coupling, latch, rod clamp, rail clamp, light, round center mount, mount bracket, pole clamp, pipe clamp, quick release clamp, rack clamp mount, bolt, screw, or handlebar clamp mount on the backrest frame of wheelchair 202 and provides contact between the friction roller 104 and the wheelchair wheel 206, respectively. Various exemplary attachment unit 508 implementations may include any fastener adaptable to mount the device to the wheelchair.

The total weight for the entire device 100 is approximately 20 pounds. It is expected that the speed is 0-5 MPH adjustable, maximum carrying capacity of up to 260 pounds, with a maximum incline up to 10 degrees. In one embodiment, the product is classified as a Class 1 device under FDA Code of Federal Regulations Title 21 Subpart D Section 890.3910. In another embodiment, the device 100 is exempt from needing direct FDA approval, but would require a 510(k) license. In another embodiment, the device 100 is not classified as a medical device and is exempt from needing FDA approval.

It would be readily apparent to those skilled in the art that second retractable friction roller; second engagement unit; and second motor performs exactly same functions as described in the description for retractable friction roller; engagement unit; and motor respectively.

In other embodiments one of ordinary skill in the art will be able and may make changes to the size and materials of the friction roller; the size and type of motor or battery used; and/or the type of controller or joystick; and the size and type of attachment devices used to fix the device to the manual wheelchair such as but not limited to a screw clamp. In one embodiment a casing for each of the two units may be added for safety, convenient travel and appearance. In another embodiment, the device may be used as a power assist to any object that is traditionally transported on wheels via manual propulsion, such as baggage carts.

Some wheelchair power assist device designs may be adapted with a sensor, and configured to automatically stop the wheelchair in an emergency situation detected based on information captured by the sensor. For example, an exemplary wheelchair may be configured to determine the speed of the wheelchair relative to the ground based on sensor data, compare the detected speed to a predetermined maximum safe speed, and automatically mitigate the unsafe speed based on stopping a motor, reducing the speed of a motor, or reversing a motor. The speed sensor may be, for example, a shaft encoder configured in a wheel. The speed sensor may be a Time of Flight (ToF) sensor pointed forward from the wheelchair passenger, in line with the direction the passenger would typically face.

Various wheelchair power assist device implementations may include an emergency kill switch configured to permit a user to manually stop the wheelchair in an emergency situation detected by the user. For example, the joystick may be configured with a button adapted to stop the motor to prevent serious injury or damage in an emergency situation. The switch may be configured as a dead-man switch, which would have to be actively engaged by a user seated in the chair for the wheelchair power assist to move the wheelchair. In some cases, the dead-man switch may be implemented with a key lock configured to prevent the motor from activating unless the key is present and turned to the activate position. The dead-man switch may be a weight sensor configured in the wheelchair seat, to prevent motor activation unless body weight of at least a predetermined threshold weight is detected in the wheelchair seat. The threshold weight may be configurable to a specific numeric weight, or to a weight selectable from a range of weights. The dead-man switch may be configured to stop the motor if the wheelchair passenger leaves the wheelchair seat.

Some wheelchair power assist device designs may include one or more handle configured to permit a user to grasp the one or more handle while carrying the device. The one or more handle may me rotatably secured with swivels to reduce the user's effort balancing the load while carrying the device. The one or more handle may be configured with a latch mechanism to secure the handle in the wheelchair power assist device when the handle is not in use.

In some wheelchair power assist device implementations, lights may be configured on the front or back of the device. The lights may be warning lights, configured to be visible to others not riding in the wheelchair. The lights may be headlights such as spotlights or floodlights, configured to improve the effective vision of the person riding in the wheelchair. Warning lights may be various colors and may be configured to blink or flash in various patterns to warn others or make the wheelchair more visible to others. Headlights or spotlights may be configured with a swivel mount permitting the wheelchair passenger to manually direct light in a direction of interest. In an illustrative example, the light swivel mount direction may be adjustable in pan and tilt modes under control of motors governed by the joystick.

Various wheelchair power assist device power source designs may include an interchangeable battery replacement system configured to adapt batteries of various diverse form factors and electrical connection geometries to a common form factor designed to electrically connect to and power the wheelchair.

Figure 12A:
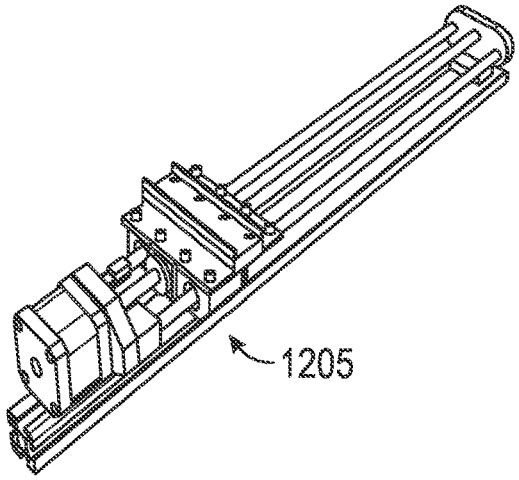
FIGS. 12A-12C illustrate perspective views of exemplary engagement unit component implementations.
Figure 12B:
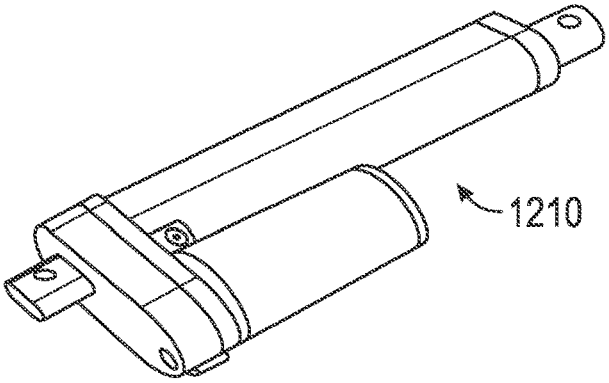
Figure 12C:
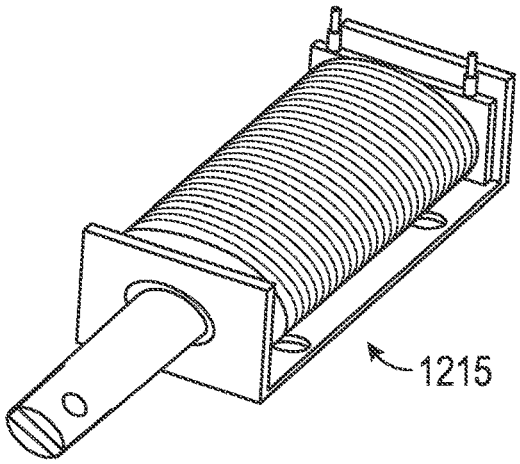

In an illustrative example, some wheelchair power assist device designs may be adapted with an electronic engage and disengage (described with reference to at least FIGS. 12A-C). Some electronic engage and disengage implementations may be configured to be activated using a push button, switch, speech, and via Bluetooth®. Various electronic engage and disengage designs may be integrated with a communication unit to permit operation of the electronic engage and disengage via a joystick. For example, the communication unit may be configured to activate the electronic engage and disengage in response to a predetermined joystick motion pattern. In an illustrative example, the predetermined joystick motion pattern may be programmed into the communication unit by a user. In this example, the communication unit may be configured to activate the electronic engage and disengage in response to the communication unit recognizing the predetermined joystick motion pattern programmed by the user. In some examples, the electronic engage and disengage may be configured to be activated by the communication unit in response to predetermined voice command received by a microphone configured with the communication unit. The predetermined voice command may include a recorded voice command selected by a user. In an illustrative example, the electronic engage and disengage may be configured to be activated via Bluetooth®. For example, the user's mobile device may be configured with a mobile application designed to link via Bluetooth® with the wheelchair communication unit, and provide a user interface adapted to controlling the wheelchair systems including motors and the electronic engage and disengage. For example, a user by operating the mobile application could activate the electronic engage and disengage, and control motor speed, to facilitate control of the wheelchair. In various designs, a wheelchair speech control interface may be implemented in a mobile application to permit the user to control the wheelchair with verbal commands received by the user's mobile device.

Potential limitations include the following: the device may not work if the maximum weight limit is exceeded; the maximum incline is exceeded; the friction roller is not engaged properly to the powertrain; operation on wet surfaces due to slippage, operation on ice, sand, or oily surfaces, if the battery, motor, or grip components are damaged, if the wheels are locked or do not freely rotate, or if operated in excessive heat.

In an aspect, a method to convert a manual wheelchair (202) to an electronic wheelchair is disclosed, the method comprising: operably connecting a joystick (102) to a communication unit (110); operably connecting the communication unit (110) to a motor (112); connecting an axle (114) to a rotor (116); connecting the motor (112) to the axle (114); mounting a retractable friction roller (104) on the axle (114); configuring the retractable friction roller (104) with a centerless concave rim housing (1110) designed to provide a high friction surface (1105) when the friction roller (104) is placed facing and in contact with a wheel (206); placing the retractable friction roller (104) in contact with a wheel (206) of a manual wheelchair (202); attaching to the wheelchair (202) an engagement unit (106) configured to detachably attach the retractable friction roller (104) and the wheel (206); and operably connecting a power source (108) to the motor (112) and the joystick (102).

The method may further comprise attaching the friction roller (104) to the motor (112) and attaching the motor (112) to a bracket (704) operably coupled via a lever mechanism (504) with a lever (502) to releasably engage the friction roller (104) and a wheel (206) in response to operation of the lever (502).

The method may further comprise configuring a safety fender (509) to detachably attach to the wheelchair (202), wherein the safety fender (509) fits over the retractable friction roller (104) when the safety fender (509) is attached to the wheelchair (202).

The method may further comprise attaching at least one set of brushes (510) to the safety fender (509), wherein the at least one set of brushes (510), when attached to the safety fender (509), are in contact with the wheel (206), and wherein the safety fender (509) comprises a top, an open bottom, a right side, a left side, a proximal side and a distal side, wherein each of the sides has a bottom edge and the at least one set of brushes (510) is attached to the bottom edge of the distal side of the safety fender (509).

The method may further comprise configuring the engagement unit (106) with a lever (502); operably connecting the lever (502) to a lever mechanism unit (504); and operably connecting the lever mechanism unit (504) to the motor (112) bracket.

The method may further comprise configuring the engagement unit (106) with a lever (502); operably connecting the lever (502) to a lever mechanism unit (504); operably connecting the lever mechanism unit (504) to a turnbuckle (506); and operably connecting the turnbuckle (506) to an attachment unit (508).

The method may further comprise configuring the attachment unit (508) with a spring loaded unit (404); operably connecting the spring loaded unit (404) to the retractable friction roller (104); and operably connecting a clamp (402) to the spring loaded unit (404).

The method may further comprise operably connecting a second motor (302) to a second communication unit (304) and the power source (108), and operably connecting the second communication unit (304) to the joystick (102).

The method may further comprise configuring the joystick (102) to be operably programmable to generate commands for operating the motor (112) and the second motor (302).

The method may further comprise connecting the second motor (302) to a second axle (114), and connecting the second axle (114) to a second rotor (116).

The method may further comprise mounting a second retractable friction roller (306) on the second axle (114), and placing the second roller (306) in contact with a second wheel (308) of the manual wheelchair (202).

The method may further comprise configuring the second retractable friction roller (306) with a centerless concave rim housing (1110) designed to provide a high friction surface (1105) facing the second wheel (308) of the manual wheelchair (202).

The method may further comprise attaching the second friction roller (306) to the top of the second wheel (308) behind the seating area (312).

The method may further comprise attaching the second friction roller (306) to the front of the second wheel (308) under the seating area (312).

The method may further comprise attaching the second friction roller (306) to the second wheel (308) using the arm (204) of the wheelchair (202).

The method may further comprise attaching a second engagement unit (310) to the manual wheelchair (202), wherein the second engagement unit (310) is configured to detachably attach the second friction roller (306) and the second wheel (308) of the wheelchair (202).

The method may further comprise configuring the second engagement unit (310) with a second lever (502); operably connecting the second lever (502) to a second lever mechanism unit (504); and operably connecting the second lever mechanism unit (504) to the second motor (302) bracket.

The method may further comprise configuring the second engagement unit (310) with a second lever (502); operably connecting the second lever (502) to a second lever mechanism unit (504); operably connecting the second lever mechanism unit (504) to a second turnbuckle (506); and operably connecting the second turnbuckle (506) to a second attachment unit (508).

The method may further comprise configuring the second attachment unit (508) with a second spring loaded unit (404); operably connecting the second spring loaded unit (404) to the second retractable friction roller (306); and operably connecting a second clamp (402) to the second spring loaded unit (404).

The method may further comprise attaching the friction roller (104) to a motor (112) and attaching the motor (112) to a bracket (704) operably coupled via a turnbuckle (506) with a lever (502) to releasably engage the friction roller (104) and a wheel (206) in response to operation of the lever (502).

The method may further comprise attaching the friction roller (104) to the top of the wheel (206) behind the wheelchair (202) seating area (312).

The method may further comprise attaching the friction roller (104) to the front of the wheel (206) under the wheelchair (202) seating area (312).

The method may further comprise attaching the friction roller (104) to the wheel (206) using the arm (204) of the wheelchair (202).

The method may further comprise attaching the friction roller (104) to an upper lateral wheelchair frame support (208).

The method may further comprise attaching the friction roller (104) to a lower lateral wheelchair frame support (210).

The method may further comprise attaching the friction roller (104) to a vertical wheelchair frame support (212).

In an aspect, a method to move a wheelchair (202) is disclosed, the method comprising: configuring a friction roller (104) to releasably engage with a wheel (206) of a wheelchair (202), based on attaching the friction roller (104) to the wheelchair (202); configuring the friction roller (104) to drive when engaged the wheel (206) through a contact surface (1115) with the wheel (206) above the wheel (206) center and behind the wheelchair (202) seating area (312); configuring a motor (112) to rotate the friction roller (104); and moving the wheelchair (202) based on engaging the friction roller (104) and activating the motor (112) to turn the wheel (206) through force by the friction roller (104) against the contact surface with the wheel (206).

The method may further comprise configuring a second motor (302) to rotate a second friction roller (306) configured to drive a second wheel (308) through a contact surface (1115) with the second wheel (308) above the second wheel (308) center and behind the wheelchair (202) seating area (312), based on attaching the second friction roller (306) to the wheelchair (202).

The method may further comprise folding the wheelchair (202) while the friction roller (104) remains attached to the wheelchair (202) and the second friction roller (306) remains attached to the wheelchair (202).

The method may further comprise disengaging, by a user remaining seated in the wheelchair (202) seating area (312), the friction roller (104).

In another aspect, a method to move a wheelchair (202) is disclosed, the method comprising: configuring a friction roller (104) to releasably engage with a wheel (206) of a wheelchair (202), based on attaching the friction roller (104) to the wheelchair (202); configuring the friction roller (104) to drive when engaged the wheel (206) through a contact surface (1115) with the wheel (206) in front of the wheel (206) under the wheelchair (202) seating area (312); configuring a motor (112) to rotate the friction roller (104); and moving the wheelchair (202) based on engaging the friction roller (104) and activating the motor (112) to turn the wheel (206) through force by the friction roller (104) against the contact surface (1115) with the wheel (206).

The method may further comprise configuring a second motor (302) to rotate a second friction roller (306) configured to drive a second wheel (308) through a contact surface (1115) with the second wheel (308) in front of the second wheel (308) under the wheelchair (202) seating area (312), based on attaching the second friction roller (306) to the wheelchair (202).

In another aspect, a method to move a wheelchair (202) is disclosed, the method comprising: configuring a friction roller (104) to releasably engage with a wheel (206) of a wheelchair (202), based on attaching the friction roller (104) to the wheelchair (202); configuring the friction roller (104) to drive when engaged the wheel (206) through a contact surface (1115) with the wheel (206) in front of the seating area (312) using the arm (204) of the wheelchair (202); configuring a motor (112) to rotate the friction roller (104); and moving the wheelchair (202) based on engaging the friction roller (104) and activating the motor (112) to turn the wheel (206) through force by the friction roller (104) against the contact surface (1115) with the wheel (206).

The method may further comprise configuring a second motor (302) to rotate a second friction roller (306) configured to drive a second wheel (308) through a contact surface (1115) with the second wheel (308) in front of the seating area (312) using the arm (204) of the wheelchair (202), based on attaching the second friction roller (306) to the wheelchair (202).

In another aspect, a method is disclosed to convert a manual wheelchair (202) to an electronic wheelchair, the method comprising: operably connecting a joystick (102) to a communication unit (110); operably connecting the communication unit (110) to a motor (112); connecting an axle (114) to a rotor (116); connecting the motor (112) to the axle (114); configuring a retractable friction roller (104) with a centerless concave rim housing (1110) designed to provide a high friction surface (1105) when the friction roller (104) is placed facing and in contact with a wheel (206); mounting the retractable friction roller (104) on the axle (114); attaching to the wheelchair (202) in front of the wheel (206) and below the seating area (312) an engagement unit (106) configured to detachably attach the retractable friction roller (104) and the wheel (206); and operably connecting a power source (108) to the motor (112) and the joystick (102).

The method may further comprise configuring the engagement unit (106) with a lever (502); operably connecting the lever (502) to a lever mechanism unit (504); and operably connecting the lever mechanism unit (504) to a motor (112) bracket (704).

The method may further comprise operably connecting a second motor (302) to a second communication unit (304) and the power source (108), and operably connecting the second communication unit (304) to the joystick (102).

The method may further comprise configuring the joystick (102) to be operably programmable to generate commands for operating the motor (112) and the second motor (302).

The method may further comprise connecting the second motor (302) to a second axle (114), and connecting the second axle (114) to a second rotor (116).

The method may further comprise mounting a second retractable friction roller (306) on the second axle (114), and placing the second retractable friction roller (306) in contact with a second wheel (308) of the manual wheelchair (202).

The method may further comprise configuring the second retractable friction roller (306) with a centerless concave rim housing (1110) designed to provide a high friction surface (1105) facing the second wheel (308) of the manual wheelchair (202).

The method may further comprise attaching the second retractable friction roller (306) in front of the second wheel (308) and below the seating area (312).

The method may further comprise attaching a second engagement unit (310) to the manual wheelchair (202), wherein the second engagement unit (310) is configured to detachably attach the second retractable friction roller (306) and the second wheel (308) of the manual wheelchair (202).

The method may further comprise configuring the second engagement unit (310) with a second lever (502); operably connecting the second lever (502) to a second lever mechanism unit (504); and operably connecting the second lever mechanism unit (504) to a second motor (302) bracket (704).

The method may further comprise attaching the retractable friction roller (104) to the motor (112) and attaching the motor (112) to a bracket (704) operably coupled via a lever mechanism (504) with a lever (502) to releasably engage the friction roller (104) and a wheel (206) in response to operation of the lever (502).

The method may further comprise attaching the retractable friction roller (104) to the top of the wheel (206) behind the wheelchair (202) seating area (312).

The method may further comprise placing the retractable friction roller (104) in contact with a wheel (206) of the manual wheelchair (202).

In another aspect is disclosed a method to move a wheelchair (202) comprising: configuring a retractable friction roller (104) to releasably engage with a wheel (206) of a wheelchair (202), based on attaching the retractable friction roller (104) to the wheelchair (202); configuring the retractable friction roller (104) to drive when engaged the wheel (206) through a contact surface (1115) with the wheel (206) above the wheel (206) center and to the side of the wheelchair (202) seating area (312); configuring a motor (112) to rotate the retractable friction roller (104); and moving the wheelchair (202) based on engaging the retractable friction roller (104) and activating the motor (112) to turn the wheel (206) through force by the retractable friction roller (104) against the contact surface (1115) with the wheel (206).

The method may further comprise configuring a second motor (302) to rotate a second retractable friction roller (306) configured to drive a second wheel (308) through a contact surface (1115) with the second wheel (308) above the second wheel (308) center and to the side of the wheelchair (202) seating area (312), based on attaching the second retractable friction roller (306) to the wheelchair (202).

Attaching the second retractable friction roller (306) to the wheelchair (202) may further comprise attaching the second retractable friction roller (306) to the front of the second wheel (308) under the wheelchair (202) seating area (312).

Attaching the second retractable friction roller (306) to the wheelchair (202) may further comprise attaching the second retractable friction roller (306) to the second wheel (308) using an arm (204) of the wheelchair (202).

The method may further comprise folding the wheelchair (202) while the retractable friction roller (104) remains attached to the wheelchair (202) and the second retractable friction roller (306) remains attached to the wheelchair (202).

Attaching the retractable friction roller (104) to the wheelchair (202) may further comprise attaching the retractable friction roller (104) to the front of the wheel (206) under the wheelchair (202) seating area (312).

Attaching the retractable friction roller (104) to the wheelchair (202) may further comprise attaching the retractable friction roller (104) to the wheel (206) using an arm (204) of the wheelchair (202).

In the foregoing description, it will be readily appreciated by those skilled in the art that modifications may be made to the invention without departing from the concepts disclosed herein. Such modifications are to be considered as included in the following claims, unless the claims by their language expressly state otherwise.

Various changes may be made to the disclosed configuration, operation, and form without departing from the spirit and scope thereof. In particular, it is noted that the respective implementation features, even those disclosed solely in combination with other implementation features, may be combined in any configuration excepting those readily apparent to the person skilled in the art as nonsensical. Likewise, use of the singular and plural is solely for the sake of illustration and is not to be interpreted as limiting.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present invention should not be limited by any of the above-described exemplary embodiments.

It is to be understood that the disclosure of particular features of various implementations in this specification is to be interpreted to include all possible combinations of such particular features. For example, where a particular feature is disclosed in the context of a particular aspect or implementation, or a particular claim, that feature can also be used—to the extent possible—in combination with and/or in the context of other particular aspects and implementations, and in an implementation generally.

In the present disclosure, various features may be described as being optional, for example, through the use of the verb "may;" or, through the use of any of the phrases: "in some implementations," "in some designs," "in various implementations," "in various designs," "in an illustrative example," or, "for example." For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be implemented in seven different ways, namely with just one of the three possible features, with any two of the three possible features or with all three of the three possible features.

In the present disclosure, any method or apparatus implementation may be devoid of one or more process steps or components. In the present disclosure, implementations employing negative limitations are expressly disclosed and considered a part of this disclosure.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Reference throughout this specification to "an implementation" or "the implementation" means that a particular feature, structure, or characteristic described in connection with that implementation is included in at least one implementation. Thus, the quoted phrases, or variations thereof, as recited throughout this specification are not necessarily all referring to the same implementation.

Similarly, it should be appreciated that in the above description, various features are sometimes grouped together in a single implementation, Figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims may reflect, inventive aspects may lie in a combination of fewer than all features of any single foregoing disclosed implementation. Thus, the claims following this Detailed Description are hereby expressly incorporated into this Detailed Description, with each claim standing on its own as a separate implementation. This disclosure is intended to be interpreted as including all permutations of the independent claims with their dependent claims.

Elements described herein as coupled or connected may have an effectual relationship realizable by a direct connection or indirectly with one or more other intervening elements.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other. The terms "abutting" or "in mechanical union" refer to items that are in direct physical contact with each other, although the items may not necessarily be attached together.

Recitation in a claim of the term "first" with respect to a feature or element does not necessarily imply the existence of a second or additional such feature or element.

A number of implementations have been described. Nevertheless, it will be understood that various modifications may be made. For example, the steps of the disclosed techniques may be performed in a different sequence, components of the disclosed systems may be combined in a different manner, or the components may be supplemented with other components. Accordingly, other implementations are contemplated, within the scope of the following claims.

What is claimed is:

1. An apparatus kit comprising: a first retractable friction roller configured to releasably engage with a wheelchair first wheel, wherein the first retractable friction roller includes a high friction surface configured on the first retractable friction roller to drive when engaged with the wheelchair first wheel through a contact surface with the wheelchair first wheel disposed behind a wheelchair seating area; a first engagement unit configured to be attached to a manual wheelchair, wherein the first engagement unit is configured to detachably attach the first retractable friction roller and the wheelchair first wheel; a second retractable friction roller configured to contact the manual wheelchair second wheel; and a first motor configured to rotate the first retractable friction roller and move the manual wheelchair with force by the first retractable friction roller through the contact surface with the wheelchair first wheel, wherein the first retractable friction roller and the second retractable friction roller are separated by an open space located behind the seating area of the manual wheelchair when the apparatus kit is installed with the first motor attached to one side proximal to the manual wheelchair first wheel.

2. The apparatus kit of claim 1, further comprising: the second retractable friction roller is configured to releasably engage with the wheelchair second wheel, wherein the second retractable friction roller includes a high friction surface configured on the second retractable friction roller to drive when engaged with the wheelchair second wheel through a contact surface with the wheelchair second wheel disposed behind the wheelchair seating area; a second engagement unit configured to be attached to the manual wheelchair, wherein the second engagement unit is configured to detachably attach the second retractable friction roller and the wheelchair second wheel; and a second motor configured to rotate the second retractable friction roller and move the manual wheelchair with force by the second retractable friction roller through the contact surface with the wheelchair second wheel.

3. The apparatus kit of claim 1, wherein the apparatus kit further comprises the contact surface with the wheelchair first wheel configured to be disposed above the wheelchair first wheel center.

4. The apparatus kit of claim 2, wherein the apparatus kit further comprises the contact surface with the wheelchair second wheel configured to be disposed above the wheelchair second wheel center.

5. The apparatus kit of claim 2, wherein the apparatus kit further comprises each of the first retractable friction roller and the second retractable friction roller configured with a centerless concave rim housing.

6. The apparatus kit of claim 2, wherein the apparatus kit further comprises a joystick configured to be operably connected to at least one communication unit, wherein the at least one communication unit is configured to be operably connected to the first motor and the second motor, and wherein the joystick is configured to be operably programmable to generate commands for operating the first motor and the second motor; and a power source configured to be operably connected to the first motor, the second motor, and the joystick.

7. The apparatus kit of claim 2, wherein the apparatus kit further comprises the contact surface with the wheelchair second wheel disposed above the wheelchair second wheel center, and wherein the contact surface with the wheelchair second wheel is disposed above the wheelchair second wheel center.

8. An apparatus kit comprising: a joystick configured to operably connect to a communication unit, the communication unit configured to operably connect to a first motor; said first motor comprising a first axle configured to connect to a first rotor; a first retractable friction roller comprising a centerless concave rim housing configured to provide a high friction surface facing a manual wheelchair first wheel; wherein said first retractable friction roller is configured to mount on the first axle and to contact the manual wheelchair first wheel; an engagement unit configured to attach to the manual wheelchair and to detachably attach the first retractable friction roller and the manual wheelchair first wheel; a second motor; a second retractable friction roller configured to contact the manual wheelchair second wheel; and a power source configured to operably connect to the first motor and the joystick wherein the first retractable friction roller, the first motor, the second retractable friction roller, and the second motor are separated by an open space located behind the seating area of the manual wheelchair when the apparatus kit is installed.

9. The apparatus kit of claim 8, wherein the apparatus kit further comprises the second motor is configured to operably connect to the communication unit and the power source.

10. The apparatus kit of claim 8, wherein the apparatus kit further comprises a second axle configured to connect to a second rotor.

11. The apparatus kit of claim 10, wherein the apparatus kit further comprises the second retractable friction roller is configured to mount on the second axle.

12. The apparatus kit of claim 11, wherein the apparatus kit further comprises a second engagement unit configured to attach to the manual wheelchair to detachably attach the second friction roller and the manual wheelchair second wheel.

13. The apparatus kit of claim 11, wherein the apparatus kit further comprises a second centerless concave rim housing configured to provide a high friction surface facing the manual wheelchair second wheel.

14. The apparatus kit of claim 8, wherein the joystick is operably configured to generate commands for the first motor.

15. The apparatus kit of claim 9, wherein the joystick is operably configured to generate commands for the second motor.

16. The apparatus kit of claim 8, wherein the first friction roller is configured to contact the manual wheelchair first wheel behind a seating area of the wheelchair.

17. The apparatus kit of claim 11, wherein the second friction roller is configured to contact the manual wheelchair second wheel behind a seating area of the wheelchair.

18. The apparatus kit of claim 8, wherein the apparatus kit further comprises a first lever configured to operably connect to a first lever mechanism unit; said first lever mechanism unit configured to operably connect to a first turnbuckle; and said first turnbuckle is configured to operably connect to a first attachment unit.

19. The apparatus kit of claim 12, wherein the apparatus kit further comprises a second lever configured to operably connect to a second lever mechanism unit; said second lever mechanism unit configured to operably connect to a second turnbuckle; and said second turnbuckle configured to operably connect to a second attachment unit.

20. The apparatus kit of claim 18, wherein the apparatus kit further comprises a first spring-loaded unit configured to operably connect to the first retractable friction roller; and a first clamp configured to operably connect to the first spring-loaded unit.

21. The apparatus kit of claim 19, wherein the second attachment unit comprises: a second spring-loaded unit configured to operably connect to the second retractable friction roller; and a second clamp configured to operably connect to the second spring-loaded unit.

22. The apparatus kit of claim 1, wherein the manual wheelchair is a manual foldable wheelchair and wherein the apparatus kit remains attached to the manual foldable wheelchair in a folded or unfolded configuration.

23. The apparatus kit of claim 8, wherein the manual wheelchair is a manual foldable wheelchair and wherein the apparatus kit remains attached to the manual foldable wheelchair in a folded or unfolded configuration.

* * * * *